US010357080B2

(12) United States Patent
Kohatsu et al.

(10) Patent No.: US 10,357,080 B2
(45) Date of Patent: Jul. 23, 2019

(54) ARTICLE OF FOOTWEAR COMPRISING A SOLE MEMBER WITH REGIONAL PATTERNS

(71) Applicant: NIKE, Inc., Beaverton, OR (US)

(72) Inventors: Shane S. Kohatsu, Portland, OR (US); Christopher S. Cook, Portland, OR (US); Bret Schoolmeester, Banks, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/643,933

(22) Filed: Jul. 7, 2017

(65) Prior Publication Data

US 2017/0303636 A1 Oct. 26, 2017

Related U.S. Application Data

(62) Division of application No. 14/722,740, filed on May 27, 2015, now Pat. No. 9,775,405.

(51) Int. Cl.

| | |
|---|---|
| ***A43B 13/18*** | (2006.01) |
| ***A43D 1/02*** | (2006.01) |
| ***A43B 3/00*** | (2006.01) |

(52) U.S. Cl.

CPC ..... *A43B 13/186* (2013.01); *A43B 3/0094* (2013.01); *A43B 13/181* (2013.01); *A43D 1/02* (2013.01)

(58) Field of Classification Search

CPC ..... A43B 7/0087; A43B 13/181; A43D 1/02

See application file for complete search history.

(56) References Cited

U.S. PATENT DOCUMENTS

| | | | |
|---|---|---|---|
| 1,785,410 | A | 12/1930 | Gilkerson |
| 2,150,057 | A | 3/1939 | Fisch |
| 2,885,797 | A | 5/1959 | Chrencik |
| 2,983,056 | A | 5/1961 | Murawski |
| 3,253,355 | A | 5/1966 | Menken |
| 3,418,731 | A | 12/1968 | Anciaux |
| 3,785,646 | A | 1/1974 | Ruskin |
| 4,235,026 | A | 11/1980 | Plagenhoef |
| 4,494,322 | A | 1/1985 | Klagmann |
| 4,523,393 | A | 6/1985 | Inohara |
| 4,527,345 | A | 7/1985 | Lopez Lopez |
| 4,624,061 | A | 11/1986 | Wezel et al. |

(Continued)

FOREIGN PATENT DOCUMENTS

| | | | |
|---|---|---|---|
| CA | 2107507 | A1 | 4/1994 |
| CN | 102631049 | A | 8/2012 |

(Continued)

OTHER PUBLICATIONS

Aug. 31, 2016—(WO) International Search Report and Written Opinion—App PCT/US2016/032002.

*Primary Examiner* — Ted Kavanaugh
(74) *Attorney, Agent, or Firm* — Banner & Witcoff, Ltd.

(57) ABSTRACT

An article of footwear includes an upper and a sole structure with a sole member. The sole member can be manufactured using a cushioning sole system that provides customized cushioning characteristics to different regions of a sole member. A user's foot morphology and/or preferences may be used to design the sole member. The sole member can include a set of apertures that are formed along various surfaces of the sole member.

20 Claims, 13 Drawing Sheets

(56) References Cited

U.S. PATENT DOCUMENTS

| | | | | |
|---|---|---|---|---|
| 4,956,927 | A | 9/1990 | Misevich et al. | |
| 5,044,096 | A | 9/1991 | Polegato | |
| 5,068,983 | A | 12/1991 | Marc | |
| 5,155,927 | A | 10/1992 | Bates et al. | |
| 5,664,342 | A | 9/1997 | Buchsenschuss | |
| 5,699,627 | A | 12/1997 | Castro | |
| 5,799,413 | A | 9/1998 | Argyris | |
| 6,675,502 | B1 | 1/2004 | Chen | |
| 6,874,252 | B2 | 4/2005 | Nakano | |
| 7,032,328 | B2 | 4/2006 | Wilson et al. | |
| 7,434,338 | B2 | 10/2008 | Pfander | |
| 7,464,490 | B2 | 12/2008 | Lebo | |
| 7,475,497 | B2 | 1/2009 | Hoffer et al. | |
| 7,607,241 | B2 | 10/2009 | McDonald et al. | |
| 7,707,746 | B2 | 5/2010 | Dean | |
| 7,941,938 | B2 | 5/2011 | Yu et al. | |
| 8,479,414 | B2 | 7/2013 | Baker et al. | |
| 8,584,379 | B2 | 11/2013 | Baucom et al. | |
| 8,713,819 | B2 | 5/2014 | Auger et al. | |
| 8,752,307 | B2 | 6/2014 | Cooper et al. | |
| 2002/0138923 | A1* | 10/2002 | Shaffeeullah | A43B 7/141 12/142 N |
| 2003/0217485 | A1 | 11/2003 | Oishi et al. | |
| 2004/0016148 | A1 | 1/2004 | Chen | |
| 2004/0024645 | A1 | 2/2004 | Potter et al. | |
| 2004/0159015 | A1 | 8/2004 | Dennis et al. | |
| 2004/0168354 | A1 | 9/2004 | Nguyen | |
| 2005/0071242 | A1 | 3/2005 | Allen et al. | |
| 2006/0156579 | A1 | 7/2006 | Hoffer et al. | |
| 2010/0126041 | A1 | 5/2010 | Francis | |
| 2011/0061263 | A1 | 3/2011 | Everz-Vaz | |
| 2011/0099850 | A1 | 5/2011 | Van Dyck | |
| 2011/0162234 | A1 | 7/2011 | Dean | |
| 2012/0124863 | A1* | 5/2012 | Aveni | A43B 23/0215 36/50.1 |
| 2013/0160223 | A1 | 6/2013 | Bier et al. | |
| 2013/0219746 | A1 | 8/2013 | Chiu | |
| 2013/0258085 | A1 | 10/2013 | Leedy et al. | |
| 2014/0026444 | A1 | 1/2014 | Howley et al. | |
| 2014/0182049 | A1 | 7/2014 | Prust et al. | |
| 2014/0223777 | A1 | 8/2014 | Whiteman et al. | |
| 2014/0290094 | A1 | 10/2014 | Miner | |
| 2014/0366399 | A1 | 12/2014 | Wakeland et al. | |
| 2016/0242502 | A1 | 8/2016 | Spanks | |

FOREIGN PATENT DOCUMENTS

| | | | |
|---|---|---|---|
| DE | 4333597 | A1 | 4/1994 |
| EP | 0074568 | A1 | 3/1983 |
| EP | 1795083 | A1 | 6/2007 |
| FR | 2528283 | A1 | 12/1983 |
| GB | 1512745 | A | 6/1978 |
| WO | 2006016254 | A2 | 2/2006 |
| WO | 2014100462 | A1 | 6/2014 |

* cited by examiner

ARTICLE OF FOOTWEAR COMPRISING A SOLE MEMBER WITH REGIONAL PATTERNS

RELATED APPLICATIONS

This application is a divisional application of U.S. application Ser. No. 14/722,740, titled "Article of Footwear Comprising a Sole Member with Regional Patterns," and filed on May 27, 2015 (now U.S. Pat. No. 9,775,405 B2), the entire disclosure of which is incorporated herein by reference.

BACKGROUND

The present embodiments relate generally to articles of footwear, and in particular to articles with cushioning provisions and methods of making such articles.

Articles of footwear generally include two primary elements: an upper and a sole member. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over the instep and toe areas of the foot, along medial and lateral sides of the foot, and around a heel area of the foot. The upper may also incorporate a lacing system to adjust the fit of the footwear, as well as to permit entry and removal of the foot from the void within the upper. In addition, the upper may include a tongue that extends under the lacing system to enhance adjustability and comfort of the footwear, and the upper may incorporate a heel counter.

The sole member is secured to a lower portion of the upper so as to be positioned between the foot and the ground. In athletic footwear, for example, the sole member includes a midsole and an outsole. The various sole member components may be formed from a polymer foam material that attenuates ground reaction forces (i.e., provides cushioning) during walking, running, and other ambulatory activities. The sole member may also include fluid-filled chambers, members, moderators, or other elements that further attenuate forces, enhance stability, or influence the motions of the foot, for example.

SUMMARY

In one aspect, the present disclosure is directed to a cushioning sole system for footwear, comprising a first sole member, the first sole member including an outer surface, the outer surface comprising an upper surface, a lower surface, and a sidewall. The first sole member has an interior portion, where the interior portion is disposed between the upper surface, the lower surface, and the sidewall. The first sole member also has a first set of apertures extending through the interior portion of the first sole member, where each aperture of the first set of apertures are through-hole apertures. There is also a second sole member, and the first sole member and the second sole member are configured for use in a complementary pair of footwear. The second sole member includes an outer surface, where the outer surface comprises an upper surface, a lower surface, and a sidewall. The second sole member also has an interior portion, where the interior portion is disposed between the upper surface, the lower surface, and the sidewall. A second set of apertures extends through the interior portion of the second sole member, where each aperture of the second set of apertures are through-hole apertures. The first set of apertures is arranged in a first pattern along the first sole member, and the second set of apertures is arranged in a second pattern along the second sole member. In addition, the arrangement of the first pattern is asymmetric with respect to the arrangement of the second pattern.

In another aspect, the present disclosure is directed to a method for customizing sole members for an article of footwear, the method comprising obtaining information related to a pressure distribution associated with a first foot of a wearer, and producing a first pattern of through-hole apertures corresponding to the pressure distribution associated with the first foot of the wearer. The method further comprises generating instructions to form the first pattern of through-hole apertures in a first sole member, and executing the instructions to produce a first customized sole member.

In another aspect, the present disclosure is directed to a method for making a customized sole member, the method comprising obtaining information related to a wearer's foot, and producing a first pattern of through-hole apertures. The method further comprises generating instructions to form the first pattern of through-hole apertures in a sole member, and executing the instructions to produce the customized sole member.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
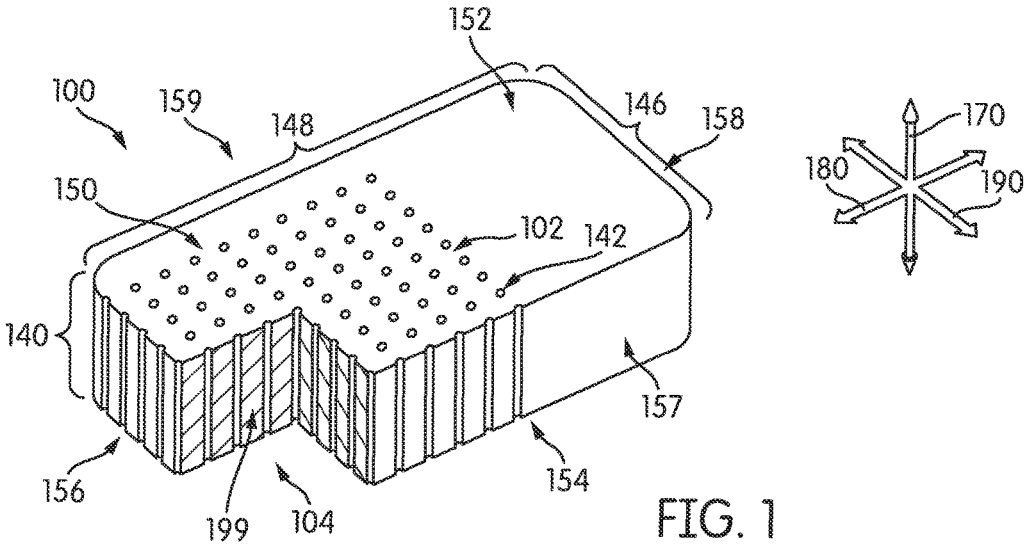
FIG. 1 is an isometric view of an embodiment of a cushioning element including apertures.
Figure 2:
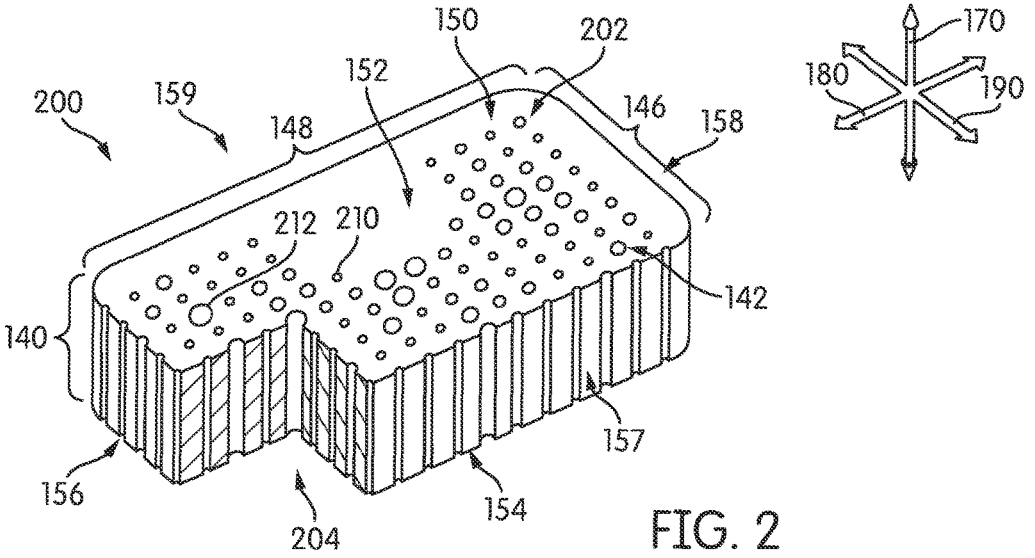
FIG. 2 is an isometric view of an embodiment of a cushioning element including apertures.

FIGS. 1 and 2 depict different embodiments of a portion of a cushioning element. A cushioning element for purposes of this disclosure can include provisions for increasing flexibility, fit, comfort, and/or stability during deformation or use. Some of the embodiments of cushioning elements as disclosed herein may be utilized in various articles of apparel. In one embodiment, the cushioning elements may be used in an article of footwear. For example, as discussed in further detail below, in one embodiment, portions of a sole member or the entire sole member may incorporate or otherwise include a cushioning element.

For consistency and convenience, directional adjectives are also employed throughout this detailed description corresponding to the illustrated embodiments. The term "lateral" or "lateral direction" as used throughout this detailed description and in the claims refers to a direction extending along a width of a component or element. For example, a lateral direction may be oriented along a lateral axis 190 may be applied to a foot (see FIG. 9), which axis and may extend between a medial side and a lateral side of the foot. Additionally, the term "longitudinal" or a "longitudinal direction" as used throughout this detailed description and in the claims refers to a direction extending across a length of an element or component (such as a sole member). In some embodiments, a longitudinal direction may be oriented along a longitudinal axis 180, which axis may extend from a forefoot region to a heel region of a foot (see FIG. 9). It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

FIG. 1 depicts an embodiment of a first cushioning element ("first element") 100, and FIG. 2 depicts an embodiment of a second cushioning element ("second element") 200. As shown in FIGS. 1-2, in some embodiments, a cushioning element can include one or more apertures 150. For purposes of this description, apertures 150 are openings, apertures, holes, tunnels, or spaces that are disposed within the cushioning element. Generally, apertures 150 are initially formed along an exterior or outer surface of the cushioning element, and can extend any distance, and along any orientation, through an interior portion 199 (e.g., the thickness, breadth, or width) of the cushioning element. It should be understood that the terms exterior or outer surface with reference to a sole member do not necessarily indicate whether the sole member is actually exposed to the outer elements. Instead, outer surface or exterior surface refers to the outermost, outward-facing layer of the sole member. Interior portion 199 can be disposed between an upper surface 152, a lower surface 154, and a sidewall in some embodiments. Throughout the specification, it should be understood that characteristics being described as associated with a single aperture or aperture set can also characterize any other aperture or aperture set that may be referred to in the various embodiments.

The embodiments described herein may also include or refer to techniques, concepts, features, elements, methods, and/or components from: (a) U.S. patent application Ser. No. 14/722,758, filed May 27, 2015, titled "Article of Footwear Comprising a Sole Member with Apertures," (b) U.S. Patent application Ser. No. 14/722,826, filed May 27, 2015, titled "Article of Footwear Comprising a Sole Member with Geometric Patterns,", and (c) U.S. patent application Ser. No. 14/722,782, filed May 27, 2015, titled "Article of Footwear Comprising a Sole Member with Aperture Patterns,"the entirety of each application being herein incorporated by reference.

In different embodiments, cushioning elements may comprise any three-dimensional shape or geometry, including regular or irregular shapes. For example, cushioning elements may be substantially flat or narrow, and/or relatively thick or wide. The geometry and dimensions of a cushioning element can be configured for the application or exercise in which it will be used. For illustrative purposes, in FIGS. 1-2, the portions of cushioning elements have a generally oblong rectangular three-dimensional shape. Furthermore, for purposes of reference, as shown in FIGS. 1-2, each cushioning element may include upper surface 152 and lower surface 154 that is disposed opposite of upper surface 152. In some cases, upper surface 152 can be disposed adjacent to or joined to another component, such as an upper (see FIGS. 16-18). In addition, in some cases, lower surface 154 can be a ground-contacting surface. However, in other cases, lower surface 154 may be disposed adjacent to another material (such as an outsole). The cushioning elements can further include additional exterior-facing surfaces. For example, as shown in FIGS. 1-2, the cushioning elements have four sidewalls, including a first side 156, a second side 157, a third side 158, and a fourth side 159. First side 156, second side 157, third side 158, and fourth side 159 may extend between upper surface 152 and lower surface 154. In addition, cushioning elements include a thickness 140 extending between upper surface 152 and lower surface 154 along vertical axis 170, and a width 146 extending from second side 157 to fourth side 159 along lateral axis 190, as well as a length 148 extending along longitudinal axis 180 from first side 156 to third side 158. Upper surface 152, lower surface 154, and sidewalls as depicted herein are associated with an outer surface of the cushioning elements.

It should be understood that other embodiments can have a fewer or greater number of exterior surfaces, and that the cushioning elements and the different regions of cushioning elements shown herein are for illustrative purposes only. In other embodiments, cushioning elements may include any contour, and may be any size, shape, thickness, or dimension, including regular and irregular shapes.

In some embodiments, apertures 150 have a rounded shape. In other embodiments, apertures 150 may include a wide variety of other geometries, including regular and irregular shapes. Apertures 150 may have a cross-sectional shape that is round, square, or triangular, for example. In some embodiments, apertures 150 may have a variety of geometric shapes that may be chosen to impart specific aesthetic or functional properties to a cushioning element. In one embodiment, apertures 150 may comprise a void that has a substantially cylindrical shape. In some embodiments, the cross-sectional diameter of the aperture may be substantially consistent or uniform throughout the length of the aperture.

In some cases, apertures 150 can be provided on or through lower surface 154 or upper surface 152 of the cushioning element. In other cases, apertures 150 can be provided on or through a side surface of the cushioning element. In one embodiment, apertures 150 can be provided on or through the side surfaces (for example, along first side 156, second side 157, third side 158, and/or fourth side 159) of the cushioning element as well as on lower surface 154 and upper surface 152 of the cushioning element.

In some embodiments, apertures 150 can provide means for decoupling or softening portions of a cushioning element in order to enhance its cushioning characteristics. For purposes of this disclosure, cushioning characteristics refer to the degree of fit, flexibility, cushioning, responsiveness, comfort, resilience, shock absorption, elasticity, and/or stability present in a portion of an element. For example, in some cases, apertures 150 can be formed in side portions and a lower portion of a cushioning element to reduce the cross-sectional profile of the element at particular regions and/or to facilitate increased flexibility between various portions of the element. In one embodiment, apertures 150 can be applied to side portions and an upper portion to form regions between adjacent portions of the element that articulate or bend with respect to one another.

Thus, in the present embodiments, the operation of the cushioning elements can involve providing a material variance in the element. The material variance can be accomplished by providing voids (apertures) that can comprise cut-outs through the cushioning element. As will be described below with respect to FIG. 14, the cut-outs can involve a removal of material from the element, thereby providing softer and/or cushioned regions in the portions that include the apertures.

Generally, apertures 150 can comprise various openings or holes arranged in a variety of orientations and in a variety of locations on or through the cushioning element. For example, as shown in FIG. 1, in some embodiments, a first aperture set 102 may include apertures 150 that extend in a direction generally aligned with vertical axis 170 through thickness 140 of first element 100. In a first cutaway section 104 of first element 100 of FIG. 1, it can be seen that the apertures of first aperture set 102 begin along lower surface 154 and extend toward upper surface 152. Thus, apertures 150 of first aperture set 102 include a series of openings 142 (i.e., gaps or openings) along an exterior surface of first element 100. In FIG. 1, both lower surface 154 and upper surface 152 comprise exterior surfaces in which openings 142 (shown here as partially formed in first cutaway section 104) are formed. As will be discussed further below, apertures 150 may extend from an initial hole along an exterior surface to form apertures of varying sizes through thickness 140 of a cushioning element. Thus, apertures 150 may be through-hole apertures in some embodiments, where the aperture has two ends (or openings 142), and one end of the apertures is open or exposed on a first exterior surface of the cushioning element, and the opposite end of the aperture is also open or exposed along another exterior surface.

Furthermore, in FIG. 2, it can be seen that in another embodiment, there can be a second aperture set 202 comprising apertures 150 that extend in a direction generally aligned with vertical axis 170 through thickness 140 of second element 200. In a second cutaway section 204 of second element 200 of FIG. 2, apertures of second aperture set 202 are formed along upper surface 152 and extend toward lower surface 154. In addition, in FIG. 2, openings 142 that comprise an exposed end of apertures 150 are disposed along upper surface 152 and lower surface 154 (not shown).

It should also be understood that in some embodiments of cushioning elements, there may be apertures 150 that are formed along other surfaces. For example, apertures 150 can extend in a direction generally aligned with vertical axis 170 through thickness 140 of second element 200. In other words, in some embodiments, apertures 150 may extend in a direction generally aligned with lateral axis 190 across width 146 of first element 100 or second element 200 and/or extend in a direction generally aligned with longitudinal axis 180 across length 148 of first element 100 or second element 200. In other embodiments, there may be regions of a cushioning element that do not include any apertures. For example, referring to FIG. 1, while a portion disposed proximate first side 156 includes apertures 150, the portion closer to third side 158 does not include any apertures 150. As will be discussed further below, providing regions without apertures can create differences in the responsiveness of the cushioning element to various pressures and/or alter the cushioning characteristics of the cushioning element.

In different embodiments, the number of apertures 150 comprising each set of apertures can vary. For example, in one embodiment, first aperture set 102 can comprise between 1 and 100 apertures, or more than 100 apertures. In another embodiment, first aperture set 102 can comprise between 40 and 70 apertures. In still other embodiments, second aperture set 202 can include more than 100 apertures. In addition, in some embodiments, second aperture set 202 can include between 1 and 30 apertures. In other embodiments, second aperture set 202 can include more than 30 apertures. Similarly, in some embodiments, cushioning elements can include a wide range of numbers of apertures. Thus, depending on the cushioning characteristics desired, there can be more apertures or fewer apertures than illustrated in any set of apertures formed in a portion of a cushioning element.

It should be understood that the various portions can differ from that shown here and are for reference purposes only. Thus, apertures 150 can include any length from zero to nearly the entire length, width, or height of the cushioning element (including a diagonal length). In cases where the cushioning element varies in geometry from the generally oblong rectangular shape shown in FIGS. 1-2, apertures can be formed such that they extend up to the maximum length, thicknesses, breadth, or width associated with the cushioning element. Thus, in some embodiments, the length of each aperture can vary with the size or dimensions of the cushioning element.

Generally, the shape of one or more apertures 150 in a cushioning element can vary. In some cases, one or more apertures 150 may have a linear configuration or shape. In other cases, one or more apertures 150 may have a nonlinear configuration or shape. In the embodiments of FIGS. 1-2, apertures 150 are shown having a generally linear shape, for example.

In different embodiments, the dimensions of one or more apertures 150 relative to one another can vary. For example, referring to FIG. 1, in some embodiments, the size of each aperture can vary. For purposes of this description, the size of an aperture can refer to the cross-sectional diameter or size of an aperture. In some cases, the volume associated with the interior of an aperture can be correlated with the average cross-sectional diameter of the aperture. Referring to FIG. 2, in some cases, each aperture in second aperture set 202 can have a substantially similar size. In other cases, two or more apertures in second aperture set 202 can have substantially different sizes. For example, a first aperture 210 has a size that is smaller than the size of a second aperture 212. In other cases, however, the sizes of each aperture in second aperture set 202 can vary in another manner. First aperture 210 may have a size that is substantially similar to or greater than the size of second aperture 212, for example. Thus, each aperture can have a size that differs from the size of other apertures, and apertures 150 located in different portions of a cushioning element can vary in size relative to one another. In other cases, the size of each aperture can vary with the size of the cushioning element. It should be understood that the size of an aperture can vary throughout a single aperture, such that one region of an aperture is larger or smaller than another region of the same aperture. However, in other embodiments, the size of an aperture may remain substantially constant throughout the length of the aperture. Some examples of this variety will be described further below.

In some embodiments, apertures on different portions of a cushioning element can be generally parallel with one another with respect to another surface or side of the element. In some cases, apertures extending from the same surface of a cushioning element may be generally parallel with one another, such that they do not intersect. In other words, the apertures may be generally oriented in a similar direction. For example, apertures formed on lower surface 154 or upper surface 152 may be oriented in a direction generally aligned with vertical axis 170. Thus, in different embodiments, apertures 150 may be associated with approximately similar longitudinal, lateral, or vertical orientations. In other embodiments, however, apertures on the side surfaces may not be parallel with one another. In one example, there may be apertures with openings 142 on first side 156 that are oriented in one direction, and apertures with openings 142 on first side 156 that are oriented along a different direction. Therefore, it should be understood that while the embodiments of FIGS. 1-2 show apertures 150 having lengths extending along either vertical axis 170, longitudinal axis 180, or lateral axis 190, apertures can also be oriented so that they lie along any other direction (e.g., a diagonal or non-planar direction).

As a result of the inclusion of different possible configurations of apertures 150, a cushioning element may have varying responsiveness to forces. In other words, apertures 150 can be disposed in a pattern that can help attenuate ground reaction forces and absorb energy, imparting different cushioning characteristics to the element. In the embodiments of FIGS. 3-8, a sequence of images representing possible responses of the cushioning elements under a load are shown.

Figure 3:
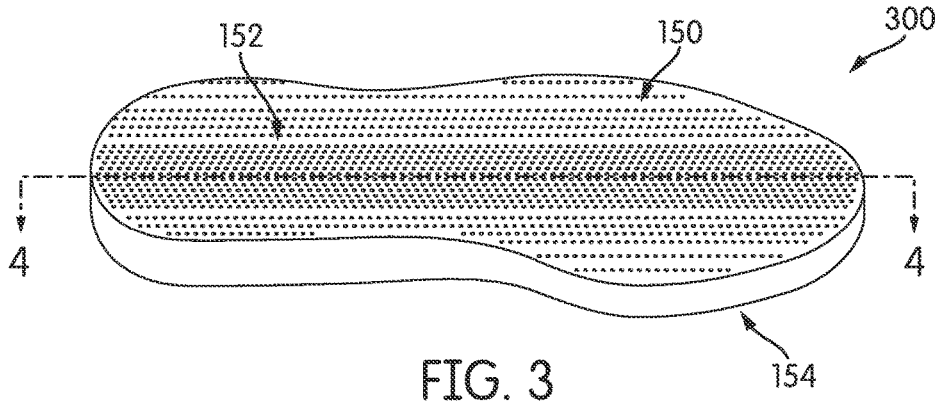
FIG. 3 is an isometric top view of an embodiment of a sole member comprising a cushioning element.
Figure 4:
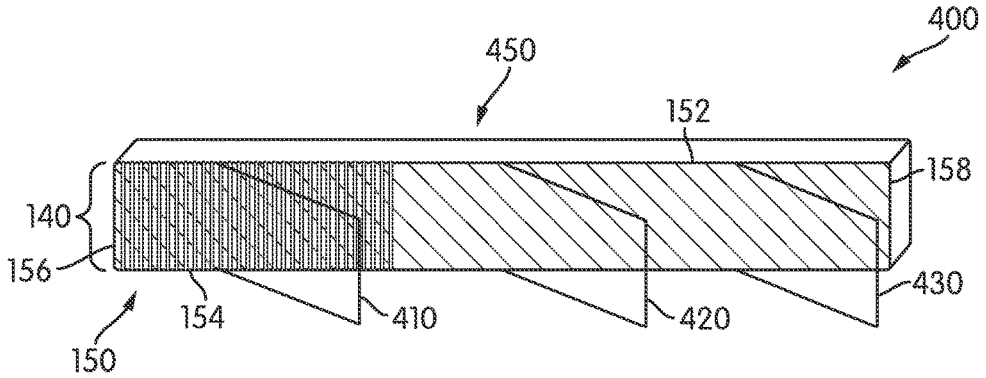
FIG. 4 is an isometric view of an embodiment of a cushioning element including apertures in an unloaded state.

For purposes of providing a contextual example to the reader, FIG. 3 depicts an embodiment of a first sole member 300. In FIG. 4, a cross-section taken along the line 4-4 of FIG. 3 in first sole member 300 is shown, depicting a third element 400. Third element 400 has a series of through-hole apertures 150 extending from lower surface 154, through thickness 140, and to upper surface 152. In some embodiments, apertures 150 may be disposed along only some areas of third element 400. For example, while there are apertures 150 disposed nearer to third side 158, the rest of third element 400 remains substantially continuous (i.e., without apertures).

For purposes of convenience, heights can be associated with different portions of third element 400. In FIG. 4, a first height 410, a second height 420, and a third height 430 are identified. First height 410 is associated with the portion of third element 400 disposed proximate first side 156, second height 420 is associated with the portion of third element 400 disposed proximate center 450, and third height 430 is associated with the portion of third element 400 disposed proximate third side 158. In FIG. 4, first height 410, second height 420, and third height 430 are substantially similar, such that thickness 140 is generally uniform throughout third element 400.

Figure 5:
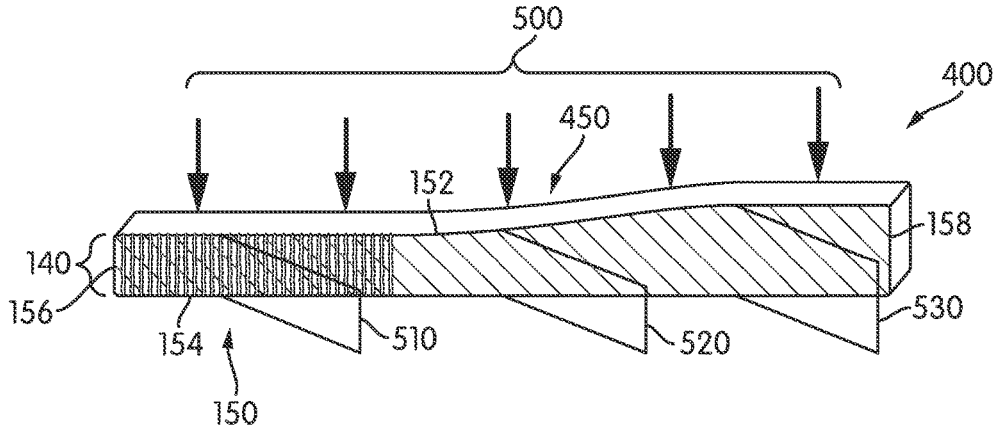
FIG. 5 is an isometric view of an embodiment of a cushioning element including apertures experiencing deformation.

When first sole member 300 and/or third element 400 undergo a first load 500 (represented by arrows), as shown in FIG. 5, the arrangement of apertures 150 can alter the cushioning responsiveness of the material. In FIG. 5, first load 500 is directed downward in a direction generally aligned with vertical axis 170 and distributed in a substantially constant or uniform manner over upper surface 152 of third element 400. As third element 400 experiences the force of first load 500, third element 400 can deform.

In some embodiments, when cushioning elements are compressed, they can deform in different ways. The deformation that occurs can be related to the location of any apertures, and/or the size and orientation of the apertures. Thus, apertures 150 may function together within the material of the cushioning element to provide variations in the relative stiffness, degree of ground reaction force attenuation, and energy absorption properties of the cushioning element. These cushioning characteristics may be altered to meet the specific demands of the activity for which the cushioning element is intended to be used, through the methods described herein.

In some embodiments, when the compressive force of first load 500 is applied to third element 400, for example, the areas that include more apertures and/or apertures of greater size or length may deform to a greater extent than the portions of third element 400 that have fewer apertures and/or apertures of smaller size or length. As a result of the application of first load 500, the aperture openings can be compressed and/or deformed, as shown in FIG. 5. In the region nearest first side 156, where there are more apertures relative to the remainder of third element 400, the deformation is the greatest. In the region nearest third side 158, where there are no apertures, the degree of deformation is substantially less.

In some embodiments, the deformation that occurs throughout third element 400 can be measurable in part by the changed shape and height of third element 400 and/or the changed shape and heights of apertures 150. Specifically, in FIG. 5, a fourth height 510, a fifth height 520, and a sixth height 530 are identified. Fourth height 510 is associated with the portion of third element 400 disposed proximate first side 156, fifth height 520 is associated with the portion of third element 400 disposed proximate center 450 of third element 400, and sixth height 530 is associated with the portion of third element 400 disposed proximate third side 158. Referring to FIGS. 4 and 5, as a result of first load 500, it can be seen that fourth height 510 is less than first height 410, fifth height 520 is less than second height 420, and sixth height 530 is less than third height 430. Furthermore, in FIG. 5, fourth height 510, fifth height 520, and sixth height 530 are substantially different from one another, such that thickness 140 is generally non-uniform throughout third element 400. In other words, various contours have been formed along upper surface 152 where first load 500 has been applied. The contours may vary in a manner generally corresponding to the arrangement of apertures 150 disposed in third element 400 in some embodiments. Thus, sixth height 530 is greater than fourth height 510 and fifth height 530. Furthermore, as third element 400 transitions from a region with apertures 150 to a region with no apertures 150 the cushioning characteristics are intermediate. Thus, fifth height 520 may be greater than fourth height 510.

Figure 6:
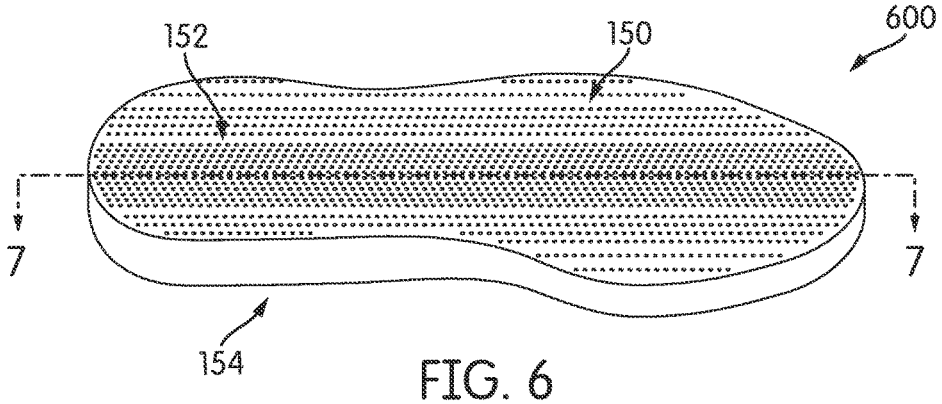
FIG. 6 is an isometric bottom view of an embodiment of a sole member comprising a cushioning element.
Figure 7:
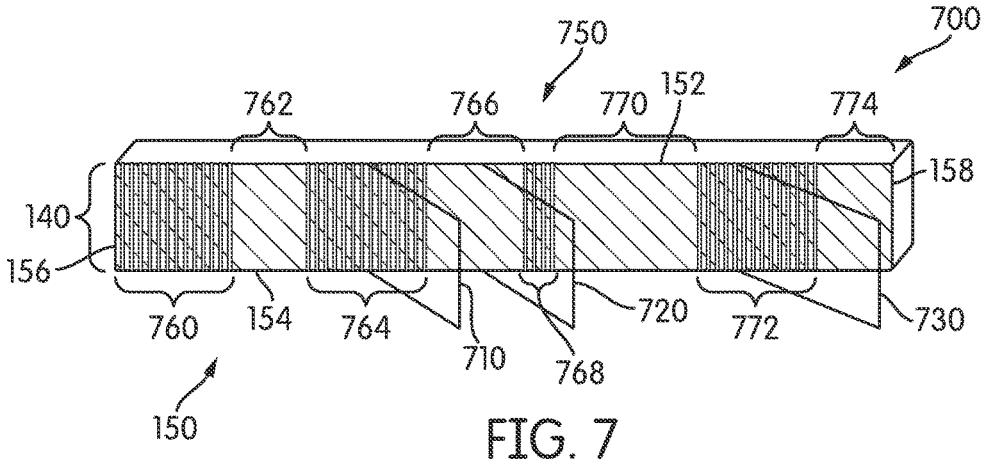
FIG. 7 is an isometric view of an embodiment of a cushioning element including apertures in an unloaded state.
Figure 8:
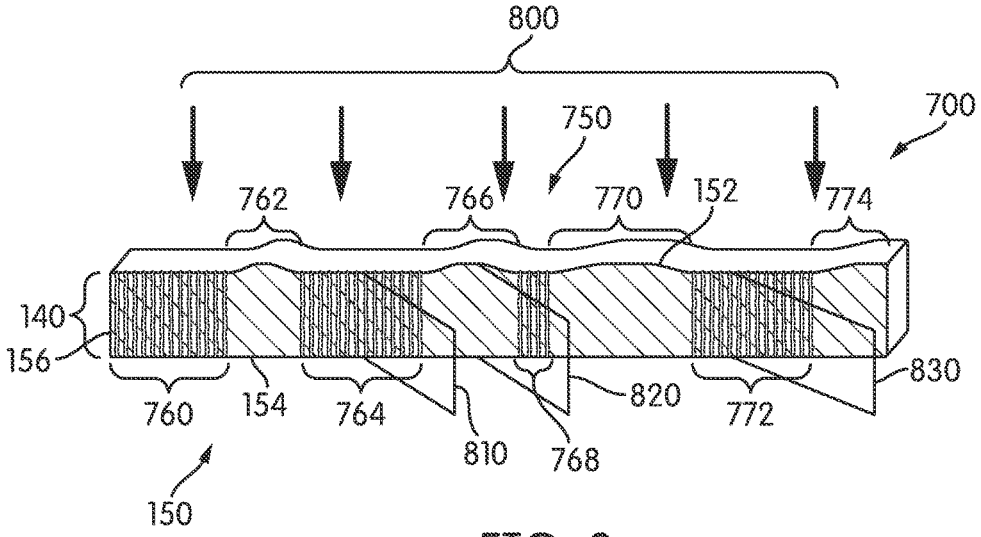
FIG. 8 is an isometric view of an embodiment of a cushioning element including apertures experiencing deformation.

Similarly, compressive forces can produce responses in other types of cushioning elements. For purposes of providing a contextual example to the reader, FIG. 6 depicts an embodiment of a second sole member 600. In FIG. 7, a cross-section taken along the line 7-7 of FIG. 6 in second sole member 600 depicts an unloaded fourth cushioning element ("fourth element") 700. Fourth element 700 has a series of through-hole apertures 150 extending from lower surface 154, through thickness 140, to upper surface 152. As noted above, in some embodiments, apertures 150 may be disposed along only some areas of fourth element 700. In FIGS. 7 and 8, fourth element 700 includes a first region 760, a second region 762, a third region 764, a fourth region 766, a fifth region 768, a sixth region 770, a seventh region 772, and an eighth region 774. First region 760, third region 764, fifth region 768, and seventh region 772 comprise portions that include apertures 150, while second region 762, fourth region 766, sixth region 770, and eighth region 774 comprise portions that do not include apertures 150.

When second sole member 600 and/or fourth element 700 undergo a second load 800 (represented by arrows), as shown in FIG. 8, the arrangement of apertures 150 can alter the cushioning responsiveness of the material. In FIG. 8, second load 800 is directed downward in a direction generally aligned with vertical axis 170 and distributed in a substantially constant manner over upper surface 152 of fourth element 700. Similar to third element 400 described with respect to FIGS. 3-5, as fourth element 700 experiences the force of second load 800, fourth element 700 can deform. The deformation that occurs can be related to the location of any apertures, and/or the size and orientation of the apertures in some embodiments.

When the compressive force of second load 800 is applied to fourth element 700, for example, the areas that include more apertures and/or apertures of greater size may deform to a greater extent than the portions of fourth element 700 that have fewer apertures and/or apertures of smaller size. Thus, as a result of the application of second load 800, any aperture openings or passageways can be compressed and/or deformed. In some embodiments, in regions with apertures, the cushioning response can be greater relative to the regions without apertures.

For purposes of convenience, heights are associated with different portions of fourth element 700. For example, referring to FIG. 7, a seventh height 710 is associated with third region 764, an eighth height 720 is associated with fourth region 766, and a ninth height 730 is associated with seventh region 772. It can be seen that in the unloaded configuration of FIG. 7, seventh height 710, eighth height 720, and ninth height 730 are substantially similar, such that thickness 140 is generally uniform through fourth element 700.

However, when fourth element 700 undergoes second load 800 (represented by arrows), as shown in FIG. 8, the arrangement of apertures 150 can alter the responsiveness of the material. In FIG. 8, a tenth height 810 associated with third region 764, an eleventh height 820 associated with fourth region 766, and a twelfth height 830 associated with seventh region 772 can be identified.

Referring to FIGS. 7 and 8, in response to second load 800, the overall height of fourth element 700 is lessened. For example, tenth height 810 is less than seventh height 710, eleventh height 820 is less than eighth height 720, and twelfth height 830 is less than ninth height 730. Comparing FIG. 7 with FIG. 8, it can be seen that in the regions where there are no apertures, the degree of deformation is substantially less. For example, while the entire surface of fourth element 700 is compressed and the overall height of the cushioning element decreases, various contours can be formed along upper surface 152 where second load 800 has been applied. It can be seen that tenth height 810 differs substantially from eleventh height 820, and eleventh height 820 differs from twelfth height 830, such that thickness 140 is generally non-uniform throughout fourth element 700. In some embodiments, these contours may vary in a manner generally corresponding to the arrangement of apertures 150 disposed in fourth element 700. Thus, eleventh height 820, which is associated with an area that does not include apertures, is greater than tenth height 810 and twelfth height 830, which include apertures. This allows each area to provide different cushioning properties.

Thus, exposure to various forces may also produce a change in the shape or geometry, size, and/or height of cushioning elements and the apertures that may be disposed within the cushioning element. It should be understood that while first load 500 and second load 800 are shown as being generally uniform, other loads may be non-uniform. Depending on the magnitude and the direction of the force (s) applied, changes in area, volume, dimensions, and/or shape of the cushioning element may vary. In some embodiments, a different force may permit the cushioning element to expand in a lateral or longitudinal direction, such that the overall length of the element increases. In other embodiments, different forces may alter the responses of the cushioning element.

It should be noted that the various degrees of deformation described and shown here are for purposes of illustration. In some situations, the cushioning element may not undergo compression to the extent depicted, or may deform more or less, depending on various factors such as the materials used in the production of the cushioning element, as well as its incorporation in other objects or articles. For example, if a cushioning element is joined or attached to a less reactive material, the compressive and/or expansive properties described herein may differ, or be limited. In some embodiments, when the cushioning element is joined to a strobel or other structure, the capacity of expansion may decrease. In some embodiments, the perimeter of the cushioning element may be fixed, e.g., bonded to a strobel layer or another sole layer. However, in such embodiments, the cushioning characteristics of the cushioning element may still facilitate increased flexibility and cushioning.

Furthermore, it should be understood that while third element 400 and fourth element 700 may experience various forces and deformation, the deformation may be elastic. In other words, once the load is removed or decreased, the cushioning element may recover and return to its original dimensions and/or shape, or to dimensions and/or a shape substantially similar to the original, unloaded configuration.

It should be understood that, in some embodiments, the shape or orientation of the apertures may also change. Depending on the magnitude and the direction of the force (s) applied, the changes in area or shape may vary. For example, in one embodiment, third element 400 and/or fourth element 700 may be exposed to a force or load whereby apertures become deformed not only by becoming more compact but also by curling or otherwise becoming increasingly non-linear and/or irregular. In one embodiment, the area or volume of an aperture may increase when a compressive force is applied.

Thus, exposure to various forces may also produce a change in the shape or geometry, size, and/or height of cushioning elements and the apertures that may be disposed within the cushioning element. It should be understood that while first load 500 and second load 800 are shown as being generally uniform, other loads may be non-uniform. Depending on the magnitude and the direction of the force (s) applied, changes in area or shape of the cushioning element may vary. In some embodiments, a different force may permit the cushioning element to expand in a lateral or longitudinal direction, such that the overall length of the element increases. In other embodiments, different forces may alter the responses of the cushioning element.

It should be noted that the various degrees of deformation described and shown here are for purposes of illustration. In some situations, the cushioning element may not undergo compression to the extent depicted, or may deform more or less, depending on various factors such as the materials used in the production of the cushioning element, as well as its incorporation in other objects or articles. For example, if a cushioning element is joined or attached to a less reactive material, the compressive and/or expansive properties described herein may differ, or be limited. In some embodiments, when the cushioning element is joined to a strobel or other structure, the capacity of expansion may decrease. In some embodiments, the perimeter of the cushioning element may be fixed, e.g., bonded to a strobel layer or another sole layer. However, in such embodiments, the cushioning characteristics of the cushioning element may still facilitate increased flexibility.

Furthermore, it should be understood that while third element 400 and/or fourth element 700 may experience various forces and respond by deforming, the deformation may be elastic. In other words, once the load is removed or decreased, the cushioning element may recover and return to its original dimensions and/or shape, or to dimensions and/or a shape substantially similar to the original, unloaded configuration.

As noted above, the cushioning elements described herein may be utilized with various components or articles. For example, the degree of elasticity, cushioning, and flexibility of a sole component such as a sole member can be important factors associated with comfort and injury prevention for an article of footwear. FIGS. 9-12 depict an embodiment of a method of designing a customized sole member for an article of footwear.

Figure 9:
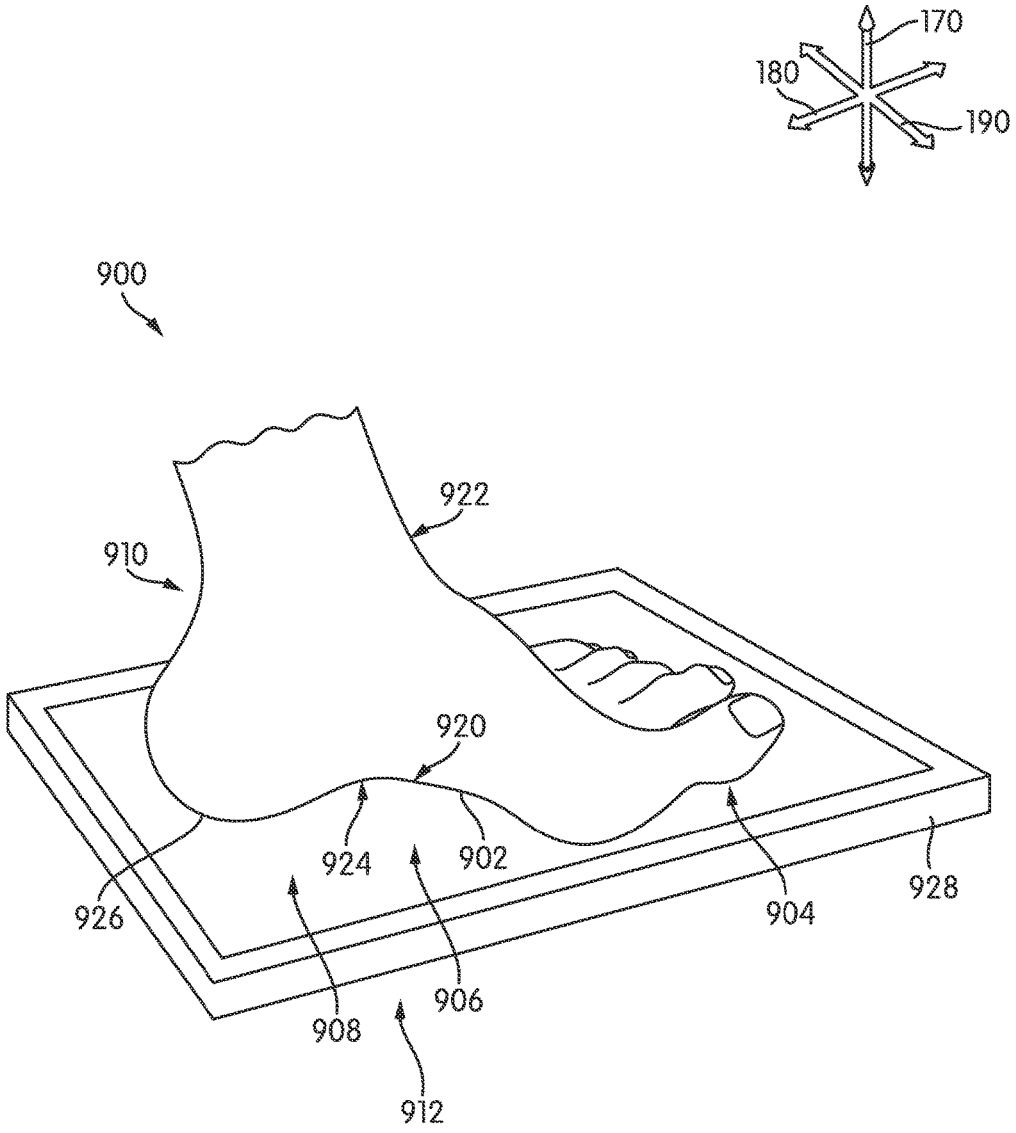
FIG. 9 illustrates an embodiment of the use of a device for obtaining three-dimensional foot data.

FIG. 9 shows the three-dimensional shape of a plantar surface 902 of a foot 900 being measured using a data collection apparatus 928. In some cases, data collection apparatus 928 can be a force platform. In other cases, data collection apparatus 928 can comprise one of the commercially available systems for measuring plantar pressure (e.g., Emed sensor platform, Pedar insole system, F-Scan system, Musgrave footprint system, etc.). Plantar pressure measurement systems can provide a means of obtaining specialized information regarding a foot that can be used to customize footwear for individuals. In some embodiments, the magnitude of pressure can be determined by dividing the measured force by the known area of the sensor or sensors evoked while the foot was in contact with the supporting surface in some embodiments.

For purposes of reference, foot 900, representations of foot 900, components associated with foot 900 (such as an article of footwear, an upper, a sole member, a computer-aided design of foot 900, and other components/representations) may be divided into different regions. Foot 900 may include a forefoot region 904, a midfoot region 906, and a heel region 908. Forefoot region 904 may be generally associated with the toes and joints connecting the metatarsals with the phalanges. Midfoot region 906 may be generally associated with the metatarsals of a foot. Heel region 908 may be generally associated with the heel of a foot, including the calcaneus bone. In addition, foot 900 may include a lateral side 910 and a medial side 912. In particular, lateral side 910 and medial side 912 may be associated with opposing sides of foot 900. Furthermore, both lateral side 910 and medial side 912 may extend through forefoot region 904, midfoot region 906, and heel region 908. It will be understood that forefoot region 904, midfoot region 906, and heel region 908 are only intended for purposes of description and are not intended to demarcate precise regions of foot 900. Likewise, lateral side 910 and medial side 912 are intended to represent generally two sides of foot 900, rather than precisely demarcating foot 900 into two halves.

Figure 10:
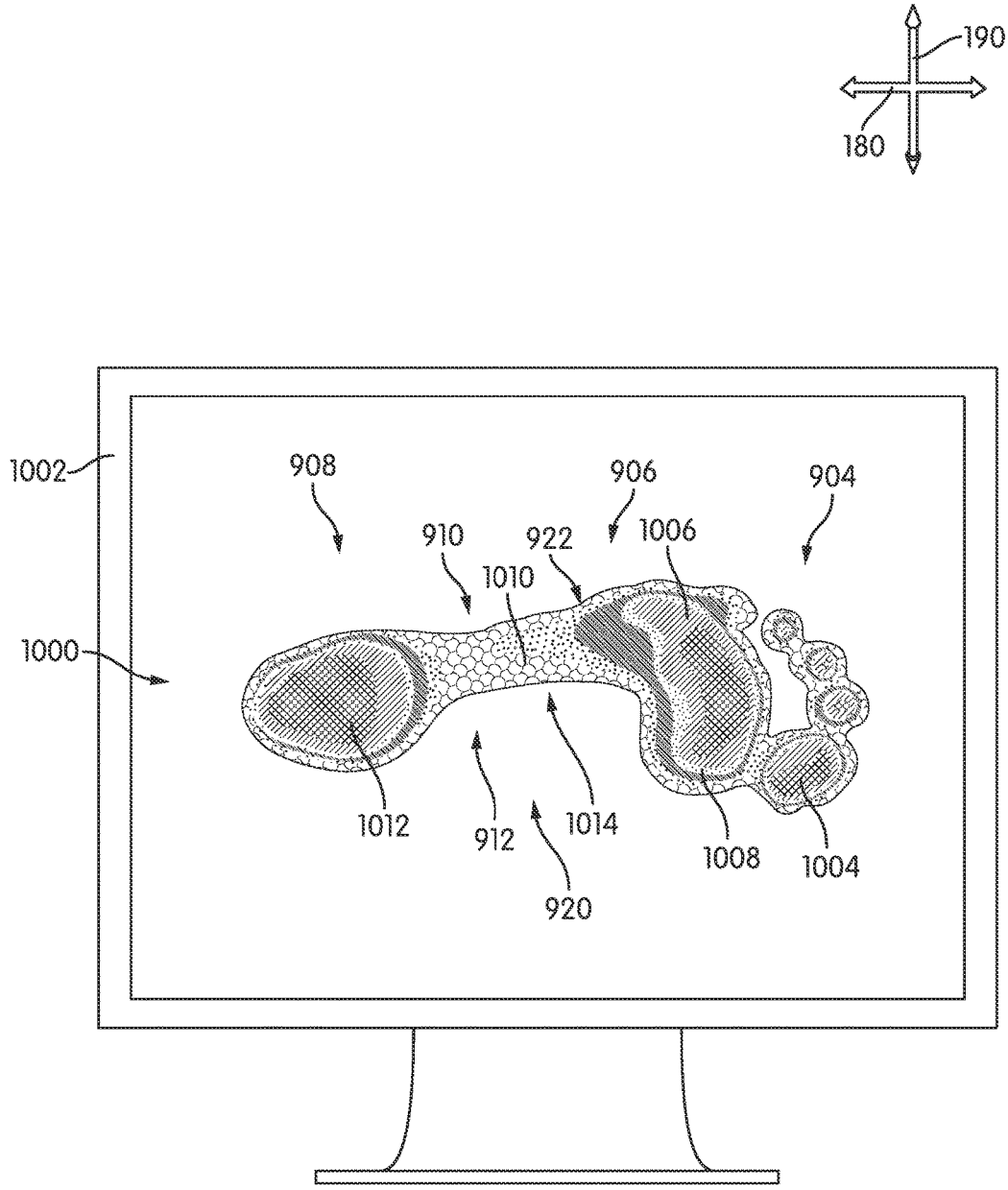
FIG. 10 schematically illustrates an embodiment of a virtual image of digitized three-dimensional foot data.

Furthermore, in the examples depicted in FIGS. 9 and 10, foot 900 and/or a virtual scan 1000 of a foot may include a medial arch area 920, associated with an upward curve along medial side 912 of midfoot region 906, and a lateral arch area 922, associated with an upward curve along lateral side 910 of midfoot region 906. The region corresponding to lateral arch area 922 is best seen in FIG. 10, which illustrates a computer screen or virtual image of digitized three-dimensional foot data. As described below, the curvature of medial arch area 920 and lateral arch area 922 may vary from one foot to another. In addition, foot 900 includes a transverse arch 924 that extends in a direction generally aligned with lateral axis 190 near forefoot region 904 along plantar surface 902. Foot 900 also includes a heel prominence 926, which is the prominence located in heel region 908 of foot 900. As shown in FIG. 9, foot 900 is illustrated as a left foot; however, it should be understood that the following description may equally apply to a mirror image of a foot or, in other words, a right foot.

Although the embodiments throughout this detailed description depict components configured for use in athletic articles of footwear, in other embodiments, the components may be configured to be used for various other kinds of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports related footwear, including, but not limited to, slippers, sandals, high-heeled footwear, loafers as well as any other kinds of footwear.

Components associated with an article of footwear are generally made to fit various sizes of feet. In the embodiments shown, the various articles are configured with approximately the same footwear size. In different embodiments, the components could be configured with any footwear size, including any conventional sizes for footwear known in the art. In some embodiments, an article of footwear may be designed to fit the feet of a child. In other embodiments, an article of footwear may be designed to fit the feet of an adult. Still, in other embodiments, an article of footwear may be designed to fit the feet of a man or a woman.

Referring to FIGS. 9 and 10, a first step of the present method is to collect data related to foot 900, such as using a barefoot pressure measurement or other data, from the foot being measured on data collection apparatus 928. Data collection apparatus 928 may include provisions for capturing information about an individual's feet. Specifically, in some embodiments, data collection apparatus 928 may include provisions to capture geometric information about one or more feet. This geometric information can include size (e.g., length, width, and/or height) as well as three-dimensional information corresponding to the customer's feet (e.g., forefoot geometry, midfoot geometry, heel geometry, and ankle geometry). In at least one embodiment, the captured geometric information for a customer's foot can be used to generate a three-dimensional model of the foot for use in later stages of manufacturing. In particular, the customized foot information can include at least the width and length of the foot. In some cases, the customized foot information may include information about the three-dimensional foot geometry. Customized foot information can be used to create a three-dimensional model of the foot. Embodiments may include any other provisions for capturing customized foot information. The present embodiments could make use of any of the methods and systems for forming an upper disclosed in Bruce, U.S. patent application Ser. No. 14/565,582, filed Dec. 10, 2014, titled "Portable Manufacturing System for Articles of Footwear," the entirety of which is herein incorporated by reference.

Some embodiments could use any of the systems, devices, and methods for imaging a foot as disclosed in Leedy et al., U.S. Patent Publication Number 2013/0258085, published Oct. 3, 2013, and titled "Foot Imaging and Measurement Apparatus," (previously U.S. patent application Ser. No. 13/433,463, filed Mar. 29, 2012), the entirety of which is herein incorporated by reference.

In FIG. 10, a screen 1002 displays virtual scan 1000 of plantar pressure distributions for foot 900. Virtual scan 1000 may provide a measured foot image or representation, including various distinct regions to indicate the pressures applied or experienced by foot 900 over its plantar surface 902. In one example, pressures can include a first pressure area 1004, a second pressure area 1006, a third pressure area 1008, a fourth pressure area 1010, and a fifth pressure area 1012. An additional pressure area 1014 is indicated where plantar surface 902 did not make an impressionable contact with the surface of data collection apparatus 928. In some embodiments, colors (not shown in FIG. 10) can be included in virtual scan 1000 to more readily distinguish variations within the measured pressure data. It should be noted that in other embodiments, different, fewer, or more pressure areas may be measured or indicated.

As seen in FIG. 10, in some embodiments, the data collected may include virtual scan 1000 of foot 900. In some embodiments, virtual scan 1000 may be used to assess the three-dimensional shape and obtain digital data in a two-dimensional or a three-dimensional reference frame. In other embodiments, virtual scan 1000 can provide a baseline shape for a footwear component. In one embodiment, three-dimensional scanned images may be used to measure the overall shape of a person's feet, and obtain two-dimensional measurements such as an outline, length, and width of foot 900. Obtaining foot geometry can establish a baseline record for the person in one embodiment. In some embodiments, other input may also be provided to supplement information regarding the person being measured. In different embodiments, additional data such as toe height information may also be obtained. In other embodiments, plaster casts of a person's foot may be taken and digitized. Additionally, other digital or imaging techniques that may be employed to capture two and three-dimensional foot shape and profile can be used to construct and/or supplement virtual scan 1000. In other embodiments, the person whose foot is being measured may provide answers to questions describing the person's physical characteristics, limitations, preferences, and/or personal lifestyle, which may impact the design of the various parts described herein.

Figure 11:
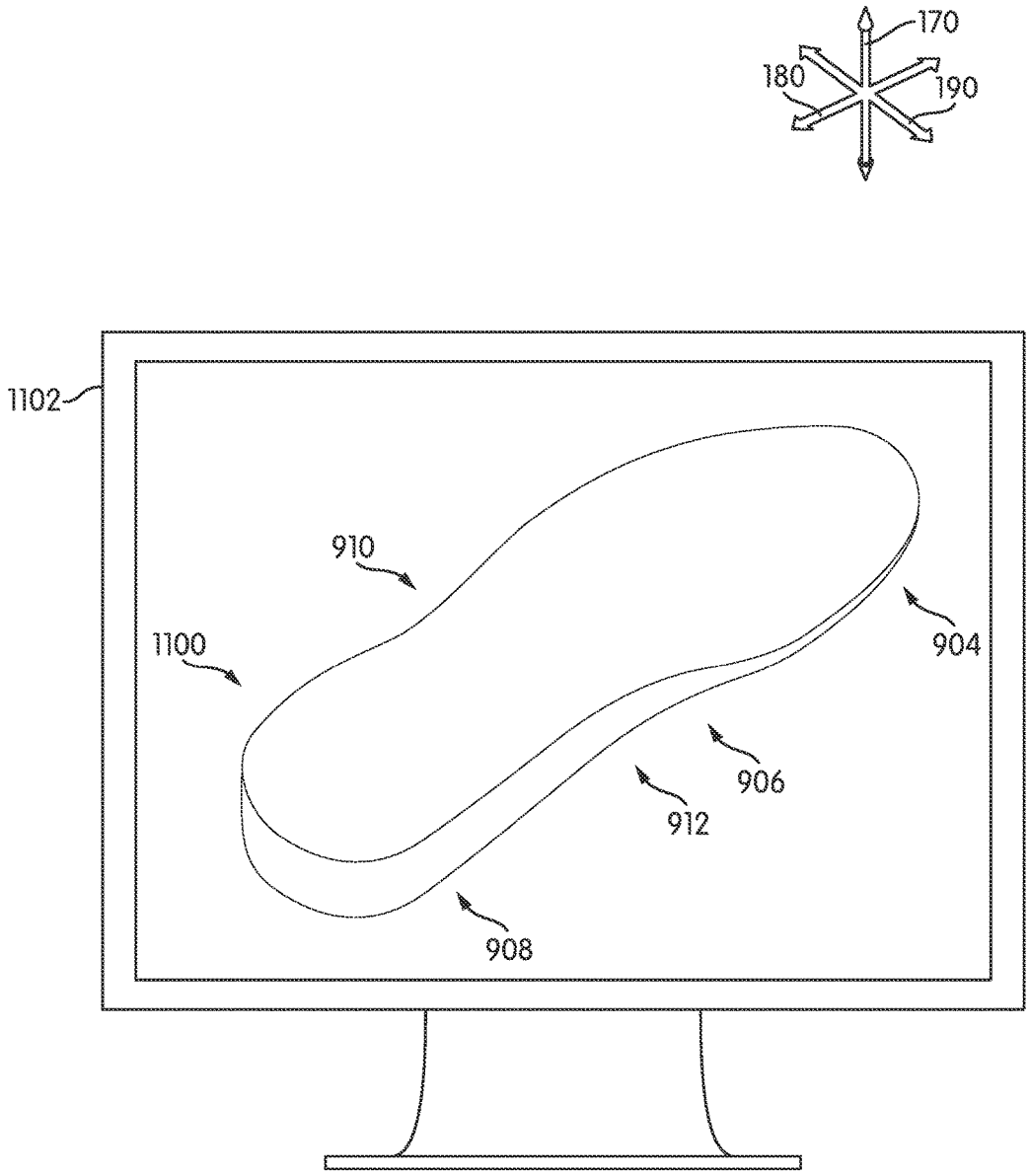
FIG. 11 schematically illustrates an embodiment of a virtual image of a template for a sole member.
Figure 12:
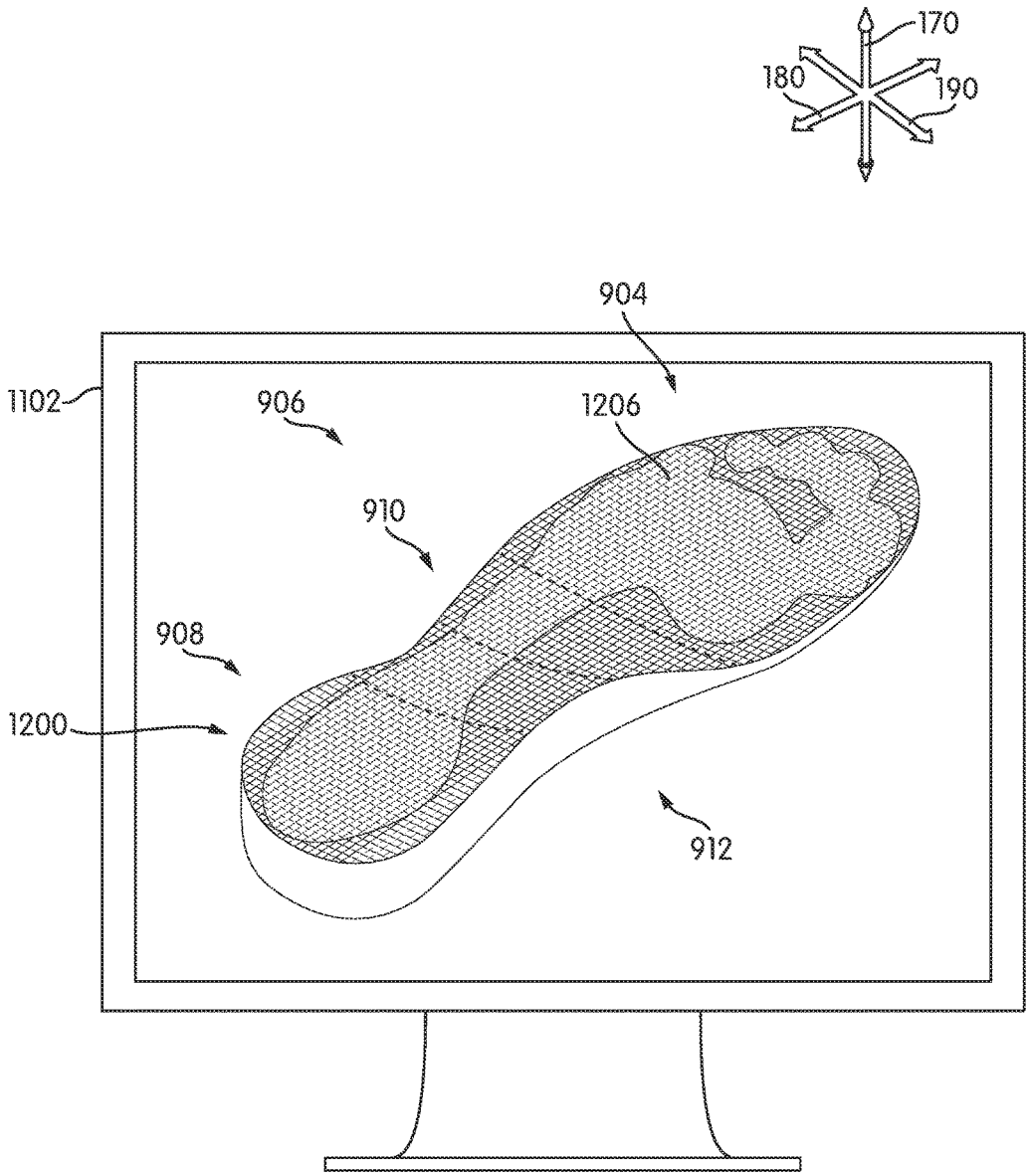
FIG. 12 schematically illustrates an embodiment of a virtual image of a customized sole structure.

In different embodiments, a sole member may provide one or more functions for an article of footwear. In FIG. 11, an image of a template of a sole member 1100 is displayed on a screen 1102. In some embodiments, sole member 1100 may attenuate ground reaction forces when compressed between the foot and the ground during walking, running, or other ambulatory activities. The configuration of sole member 1100 may vary significantly in different embodiments to include a variety of conventional or non-conventional structures. In some cases, the configuration of sole member 1100 can be selected or customized according to one or more types of ground surfaces on which sole member 1100 may be used. Examples of ground surfaces include, but are not limited to, natural turf, synthetic turf, dirt, as well as other surfaces.

Upon obtaining measurements of foot 900 (see FIG. 9), sole member 1100 may be adjusted or altered in different embodiments. As seen in the virtual representation depicted in FIG. 12, using the data collected from the steps above, a first custom sole 1200 may be designed. In some embodiments, the design may utilize an application of an integrated computer-aided design such as a computer-automated manufacturing (CAD-CAM) process. Sole member 1100, or any other template previously selected, may be provided as an input to the computer design program. In one embodiment, the three-dimensional foot shape data from virtual scan 1000 in FIG. 10 is also provided to the program.

In different embodiments, virtual scan 1000 may provide information regarding foot shape and pressure to allow the appropriate fit and comfort within the article of footwear. The information may be used to form first custom sole 1200. In some embodiments, data from virtual scan 1000 may be superimposed or otherwise incorporated into the template of sole member 1100 (see FIGS. 10 and 11). For example, there may be a process of aligning the data representing the plantar pressures of foot 900 with sole member 1100 and generating a partial or complete design of first custom sole 1200. In one embodiment, pressure contour lines 1206 may be generated during the design of first custom sole 1200. The pressure distribution may be adjusted to a "best-fit" position based upon user input in some embodiments. Once the distribution is finalized, a resiliency profile may be created. For purposes of this disclosure, a resiliency profile is a personalized pressure distribution for a user that may include the data collected during the steps described above. In some embodiments, the resiliency profile may be utilized in the production of first custom sole 1200. Thus, in one embodiment, after the resiliency profile comprising an individual's plantar pressure distributions is aligned with the template of sole member 1100, a customized sole member may be formed or manufactured.

It should be understood that, in different embodiments, the design of a sole member may include various modifications. Customized modifications may provide individual users with a wider range of comfort and fit. For example, different users may have differences in the height of the arch of foot 900. As described above, foot 900 may include multiple arches. Generally, the arch is a raised curve on the bottom surface of foot 900. When the tendons of foot 900 pull a normal amount, foot 900 generally forms a moderate or normal arch. However, when tendons do not pull together properly, there may be little or no arch. This is called "flat foot" or fallen arch. Over-pronation of a foot may be common for those with flat feet. The framework of a foot can collapse, causing the foot to flatten and adding stress to other parts of the foot. Individuals with flat feet may need orthotics to control the flattening of the foot. Moreover, the opposite may also occur, though high foot arches are less common than flat feet. Without adequate support, highly arched feet tend to be painful because more stress is placed on the section of the foot between the ankle and toes. This condition can make it difficult to fit into shoes. Individuals who have high arches usually need foot support. It should be noted that such variations in arch height are one of many possible examples of customized foot geometry that may be incorporated into a design.

Figure 13:
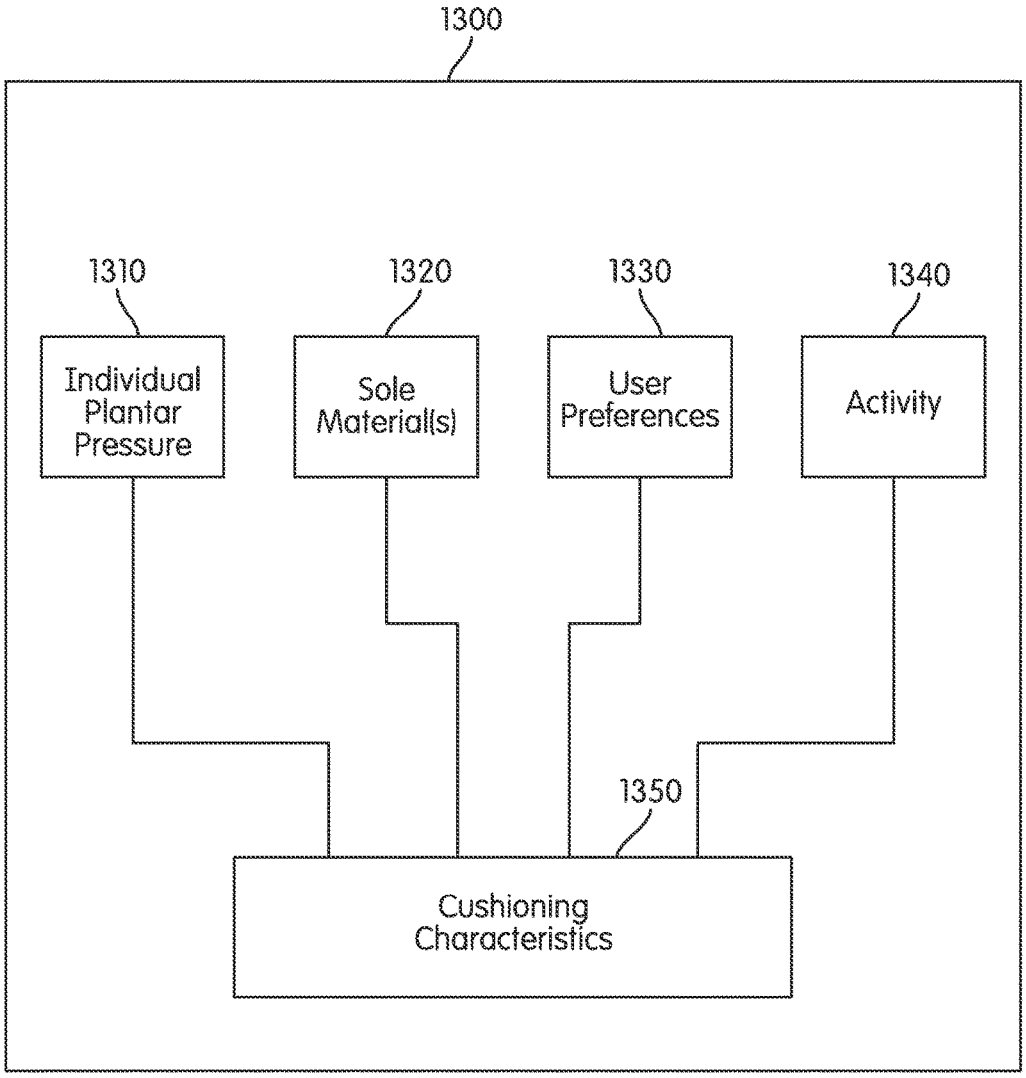
FIG. 13 is an embodiment of a flow diagram.

Referring to FIG. 13, an embodiment of an influence diagram 1300 is depicted. Influence diagram 1300 reflects some of the factors or variables that can be considered, incorporated, and/or used during the generation of the resiliency profile, permitting customization of cushioning characteristics 1350 of a sole member. For example, a first factor 1310 includes an individual's measured plantar pressure for each foot, which was discussed above with respect to FIG. 9-10. In addition, a second factor 1320 may include the materials that will be used to form the custom sole member. A third factor 1330 can be the individual user's own personal preferences regarding the type or level of cushioning desired. A fourth factor 1340 may be the activity or sport that the user will be generally engaging in while using the custom sole member. In some cases, the sole member can be designed or tailored to provide special cushioning in areas or regions of the sole member that typically experience more force or pressure from the foot during specific activities. Thus, in some embodiments, one or more of these factors can contribute to cushioning characteristics 1350 of a sole member. It should be understood that influence diagram 1300 is provided as an example, and many other factors not listed here may be included in other embodiments. Furthermore, one or more factors listed in influence diagram 1300 may be removed from consideration depending on the desired output or the goal of the custom sole member.

Once a design has been generated, as with first custom sole 1200, the sole member may be manufactured. In some embodiments, the modifications may include regions of the sole member with apertures 150 disposed along different portions of the sole member. In some embodiments, a sole member can be molded in a manner that creates apertures in the sole member. An article of footwear including apertures can be formed in any manner. In some embodiments, apertures can be created in a sole member using any known method of cutting or drilling. For example, in one embodiment, apertures can be created using laser cutting techniques. Specifically, in some cases, a laser can be used to remove material from a sole member in a manner that forms apertures in the sole member. In another embodiment, a hot knife process could be used for forming apertures in a sole member. Examples of methods for forming apertures on a sole member are disclosed in McDonald, U.S. Pat. No. 7,607,241, issued Oct. 27, 2009, titled "Article of Footwear with an Articulated Sole Structure," (previously U.S. patent application Ser. No. 11/869,604, filed Oct. 9, 2007), the entirety of which is hereby incorporated by reference.

In other embodiments, however, any other type of cutting method can be used for forming apertures. Furthermore, in some cases, two or more different techniques can be used for forming apertures. As an example, in another embodiment, apertures disposed on a side surface of a sole member can be formed using laser cutting, while apertures on a lower surface of the sole member could be formed during a molding process. Still further, different types of techniques could be used according to the material used for a sole member. For example, laser cutting may be used in cases where the sole member is made of a foam material.

Figure 14:
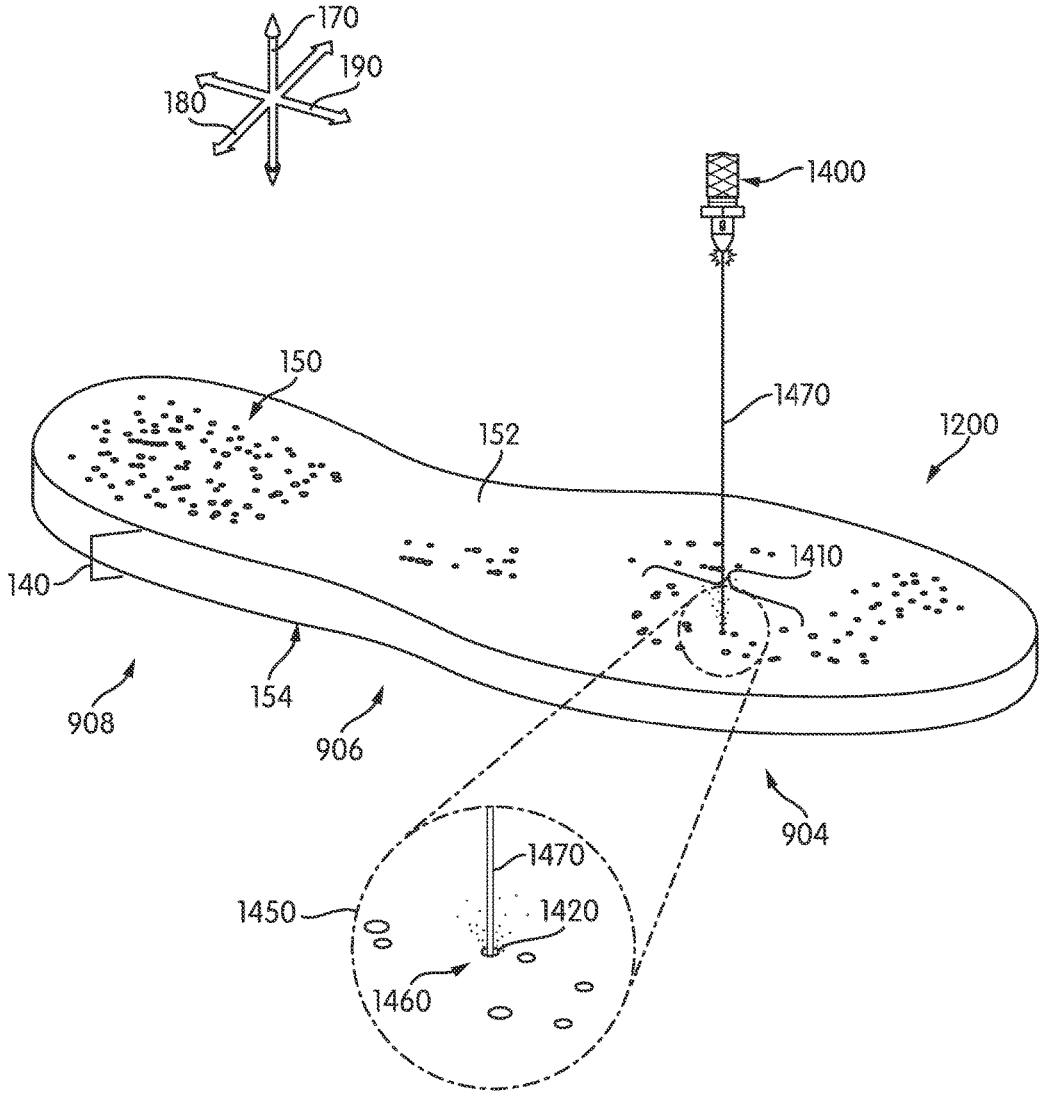
FIG. 14 is an isometric view of an embodiment of a sole member during a process of forming apertures.

In FIG. 14, a figure depicting an embodiment of a method of forming first custom sole 1200, including apertures, is shown. Referring to FIG. 14, apertures 150 can be applied to or formed in first custom sole 1200 using a laser drill 1400. In one embodiment, laser drill 1400 may be used to cut away or remove material through thickness 140 of first custom sole 1200. In other cases, there may be a greater number of laser drills. In FIG. 14, a group of apertures 1410 is being formed along a surface of first custom sole 1200. Although only apertures in one general region are shown being drilled in this example, it will be understood that a similar method could be used for creating or forming apertures in any other region of first custom sole 1200. It should further be understood that laser drill 1400 may include provisions for moving along different directions in order to direct the laser beam to the desired location. Furthermore, the sole member may be disposed such that it may be automatically or manually moved to receive a laser 1470 at the appropriate or desired location, such as along forefoot region 904, midfoot region 906, and/or heel region 908. In addition, while only one laser drill 1400 is shown in use in FIG. 14, in other embodiments, two, three, four, or more laser drills may be engaged with the sole member.

In some embodiments, referring to a magnified area 1450, it can be seen that laser 1470 may contact upper surface 152 of first custom sole 1200. When laser 1470 contacts the material, it may begin to remove material and form a hole 1420. As laser 1470 continues to engage with the material of the sole member, hole 1420 may grow through thickness 140 and form a first aperture 1460.

It may be recalled that apertures may be formed such that they differ in one or more respects from one another, or they may be formed in a uniform manner, such that they are substantially similar in size, length, and shape. Furthermore, it should be understood that laser drill 1400 may be oriented at an angle different from that shown in FIG. 14, so that laser drill 1400 can form apertures 150 oriented in a diagonal or non-parallel manner with respect to vertical axis 170, longitudinal axis 180, and/or lateral axis 190.

Thus, as described herein, in some embodiments, the arrangement of apertures on a sole member could be varied to tune properties of the sole member for specific types of physical or personal characteristics, and/or athletic activities. For example, in some cases, the arrangement of apertures on a sole member could be selected according to the type of sport for which the article of footwear is intended. In some embodiments, a manufacturer could vary the arrangement of apertures for various types of footwear, including, but not limited to, soccer footwear, running footwear, cross-training footwear, basketball footwear, as well as other types of footwear. Additionally, in other embodiments, the arrangement of apertures on a sole member could be varied according to the gender of the intended user. For example, in some cases, the aperture arrangements may vary between footwear for men and footwear for women. Still further, in some embodiments, the arrangement of apertures on a sole member could be varied according to preferences of a user for achieving desired performance effects. As an example, a desire for increased flexibility on a lateral side of the article can be accommodated by increasing the number and/or size of apertures on the lateral side of the sole member. In addition, in some embodiments, the configuration of apertures on a sole could be varied to achieve various visual or graphical effects. Furthermore, as discussed above, the arrangement of apertures can be individually customized by measuring various pressure regions of a person's foot and applying that information to the positioning and type of apertures on the sole member.

It should be understood that methods of customizing aperture configuration for particular sports, gender, and/or personal preferences can be achieved in any manner. In one embodiment, a method of customizing aperture configuration for an article can include provisions for allowing a user to select a customized aperture arrangement by interacting with a website that provides customization tools for varying the number and/or geometry of various apertures. Examples of different customization systems that can be used for customizing aperture configurations are disclosed in Allen et al., U.S. Patent Publication Number 2005/0071242, published Mar. 31, 2005, titled "Method and System for Custom-Manufacturing Footwear," (previously U.S. patent application Ser. No. 10/675,237, filed Sep. 30, 2003), and Potter et al., U.S. Patent Publication Number 2004/0024645, published Feb. 5, 2004, titled "Custom Fit Sale of Footwear," (previously U.S. patent application Ser. No. 10/099,685, filed Mar. 14, 2002) the entirety of both being hereby disclosed by reference. It will be understood that the methods of customizing aperture arrangements for an article of footwear are not limited to use with any particular customization system, and in general any type of customization system known in the art could be used.

Articles of the embodiments discussed above may be made from materials known in the art for making articles of footwear. For example, a sole member may be made from any suitable material, including, but not limited to, elastomers, siloxanes, natural rubber, other synthetic rubbers, aluminum, steel, natural leather, synthetic leather, foams, or plastics. In an exemplary embodiment, materials for a sole member can be selected to enhance the overall flexibility, fit, and stability of the article. In one embodiment, a foam material can be used with a sole member, as foam can provide the desired elasticity and strength. In another embodiment, a rubber material could be used to make a midsole of a sole member. In still another embodiment, a thermoplastic material could be used with a sole member. For example, in one embodiment, thermoplastic polyurethane (TPU) may be used to make a midsole for a sole member. In still other embodiments, a sole member may comprise a multi-density insert that comprises at least two regions of differing densities. For example, in one other embodiment, a midsole of a sole member could be configured to receive one or more inserts. Examples of different types of inserts that could be used are disclosed in Yu et al., U.S. Pat. No. 7,941,938, issued May 17, 2011, titled "Article of Footwear with Lightweight Sole Assembly," (previously U.S. patent application Ser. No. 11/752,348, filed Mar. 23, 2007) the entirety of which is hereby incorporated by reference. Also, an upper may be made from any suitable material known in the art, including, but not limited to, nylon, natural leather, synthetic leather, natural rubber, or synthetic rubber.

An article of footwear can include provisions for adjusting the flexibility characteristics of a sole member with a plurality of apertures. In some embodiments, different materials can be used with different portions of a sole. In an exemplary embodiment, portions of a sole can be filled with additional material or components to provide different types of cushioning, feel, and flexibility for a sole member. For example, in one embodiment, a core portion of a sole member may comprise a fluid-filled member, such as an air bladder. In another embodiment, one or more portions of a sole member could include hollow cavities capable of receiving fluid or other materials.

Figure 15:
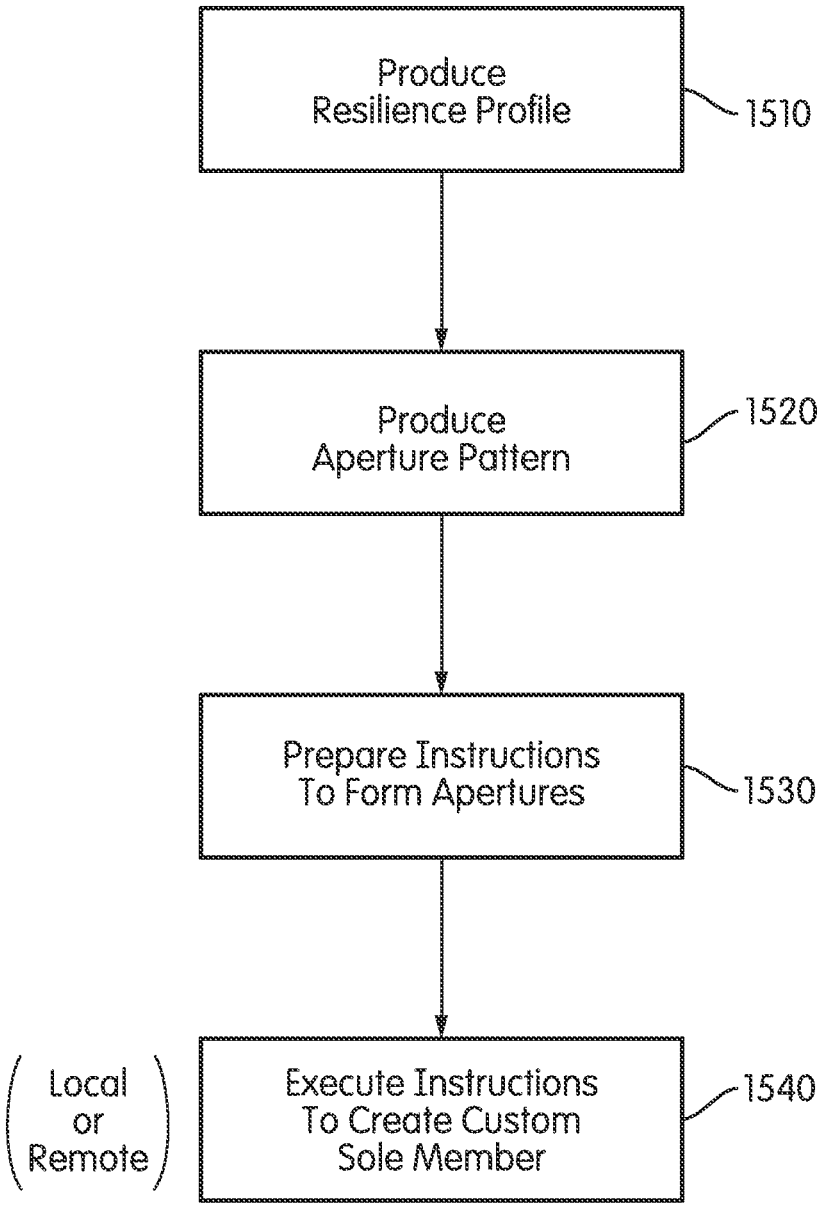
FIG. 15 is an embodiment of a flow chart.

An embodiment of the sole member production process as described herein is outlined in the flow chart of FIG. 15. In a first step 1510, the pressure distribution of a user's feet is obtained (see FIGS. 9-12 above). In other words, the pressure distributions associated with a user's left foot and/or a right foot (i.e., a first foot and a second foot) may be obtained. The pressure distributions as well as any other preferences are collected to generate a resiliency profile. In a second step 1520, the resiliency profile may be used to produce a custom configuration or pattern of apertures (e.g., position, size, lengths, orientation, etc.) in a sole member. The particular configuration of apertures generated may be stored in a virtual or digital form in some embodiments. It should be understood that in some embodiments, a first pattern of apertures may be produced for a left foot, and a second pattern of apertures may be produced for a corresponding right foot. Following the production of one or more aperture patterns, instructions to form the apertures in a sole member may be prepared or generated in a third step 1530. In some cases, the aperture pattern may be converted into a series of commands or instructions for a system to follow in order to translate the aperture pattern into mechanical or design steps for forming the customized sole member. Finally, in a fourth step 1540, the instructions are executed and a custom sole member is produced. In some embodiments, the instructions may be executed to produce a first custom sole member (e.g., for a left foot) and a complementary second custom sole member (e.g., for a right foot).

The process described herein may occur in rapid succession and in close proximity to one another in some embodiments. However, in other embodiments, one or more steps may occur spaced apart in time and location. In other words, one step may occur in a first location, and another step may occur in a second location, where the first location is different from the second location. For example, the resiliency profile of first step 1510 may be produced off-site (e.g., at a shopping outlet or a medical office, etc.), and the aperture pattern of second step 1520 may be produced in a manufacturing facility. In one embodiment, first step 1510 may occur in a location where the wearer of the customized sole member is physically present. In another example, the instructions for forming the apertures of third step 1530 may be prepared or generated in a local site, while the actual production of the custom sole member of fourth step 1540 may occur in a remote site (e.g., out of state or abroad). In some embodiments, second step 1520, third step 1530, and/or fourth step 1540 may occur in a location where the wearer is not physically present.

Figure 16:
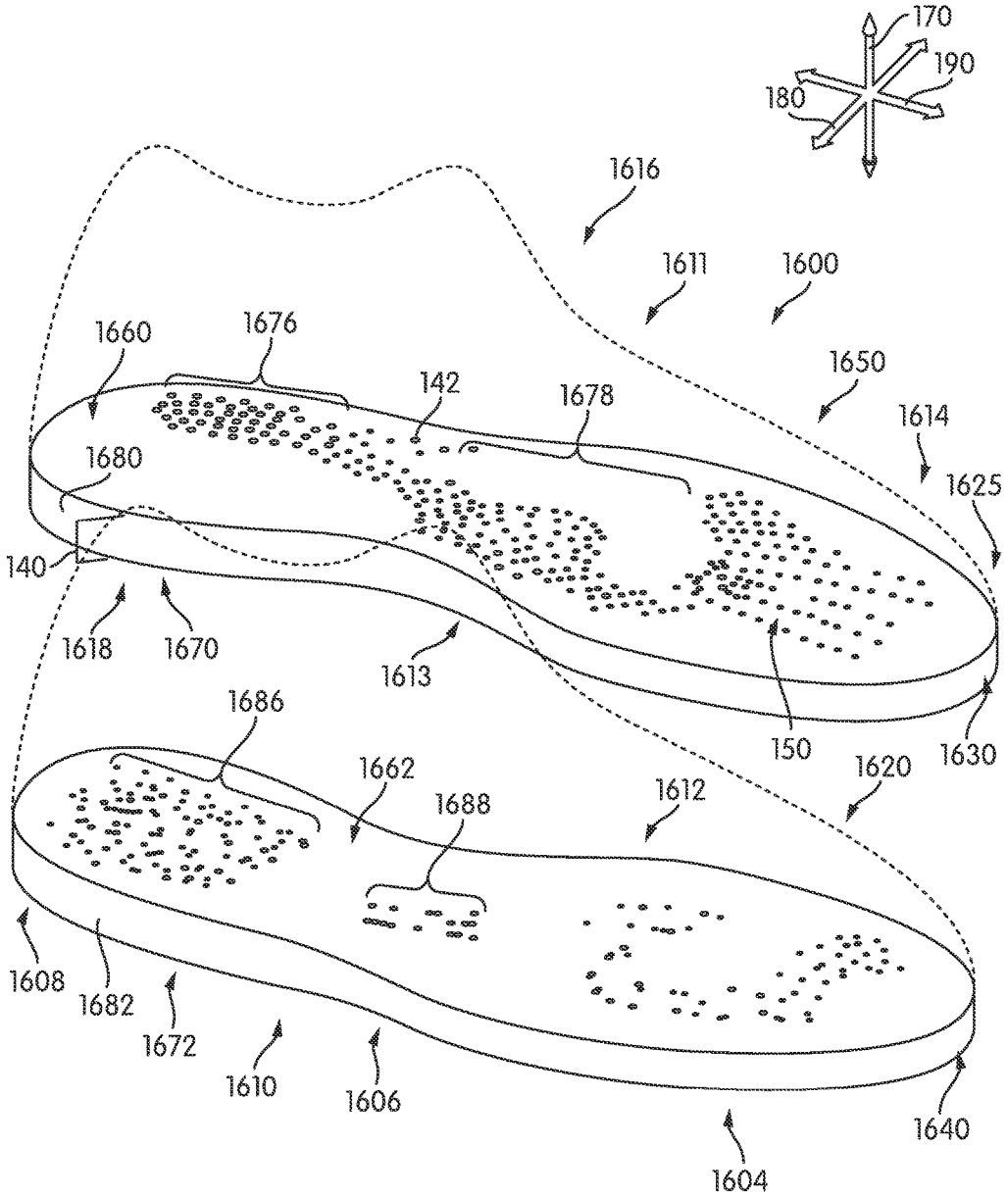
FIG. 16 is an isometric top view of an embodiment of a pair of footwear with asymmetrical sole members.
Figure 17:
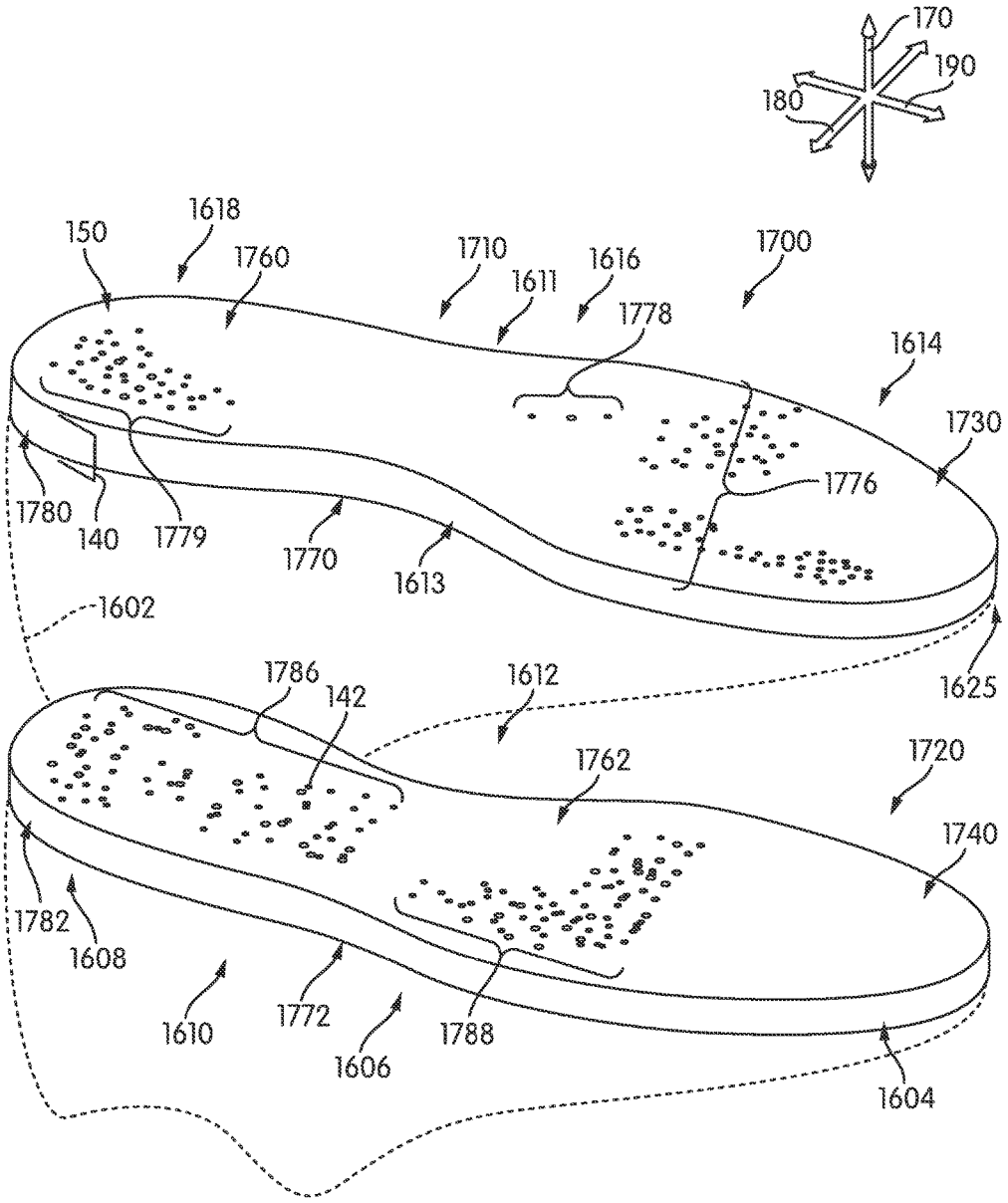
FIG. 17 is an isometric bottom view of an embodiment of a pair of footwear with asymmetrical sole members.
Figure 18:
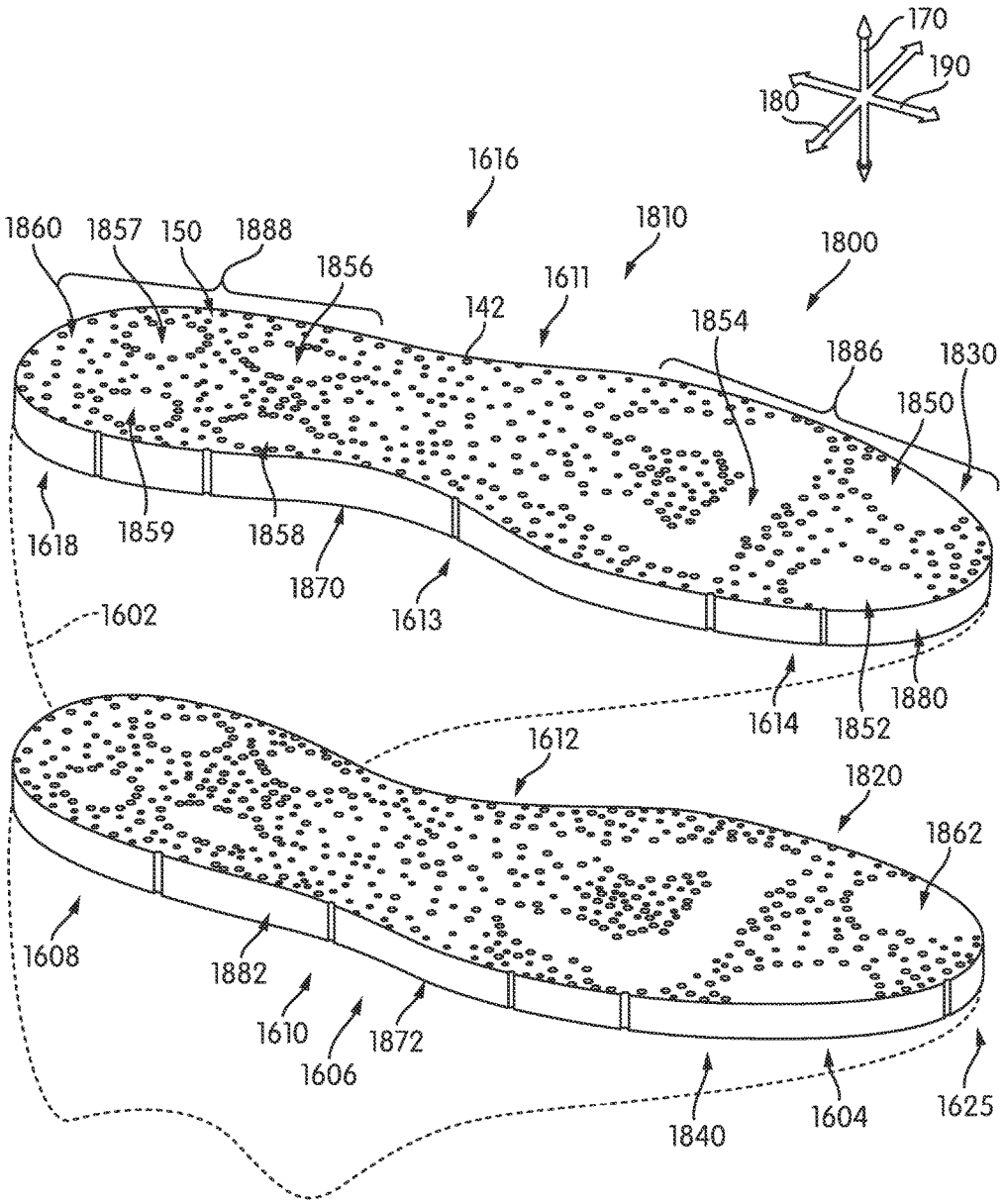
FIG. 18 is an isometric bottom view of an embodiment of a pair of footwear with sole members.

FIGS. 16-18 illustrate alternative embodiments of a custom sole member for an article of footwear. Referring to FIG. 16, a first pair of footwear ("first pair") 1600 is shown. In FIG. 17, a second pair of footwear ("second pair") 1700 is shown, and in FIG. 18, a third pair of footwear ("third pair") 1800 is shown. First pair 1600, second pair 1700, and third pair 1800 can be configured as any type of footwear including, but not limited to, hiking boots, soccer shoes, football shoes, sneakers, rugby shoes, basketball shoes, baseball shoes as well as other kinds of footwear. Each article of footwear can comprise an upper 1602 and a sole structure 1625. Sole structure 1625 can be secured to upper 1602 and extend between the foot and the ground when the article is worn. In different embodiments, sole structure 1625 may include different components. For example, sole structure 1625 may include an outsole, a midsole, and/or an insole. In some cases, one or more of these components may be optional. In one embodiment, sole structure 1625 may include a sole member, as described above.

Generally, a customized sole member may comprise any layer or element of sole structure 1625, and be configured as desired. In particular, layers or portions of the sole member may have any design, shape, size, and/or color. For example, in embodiments where an article of footwear is a basketball shoe, a sole member could include contours shaped to provide greater support to heel prominence. In embodiments where the article of footwear is a running shoe, the custom sole member could be configured with contours supporting a second forefoot region 1604. In some embodiments, sole structure 1625 could further include provisions for fastening to an upper or another sole layer, and may include still other provisions found in footwear sole members. Also, some embodiments of sole structure 1625 may include other materials disposed within the custom sole member, such as air bladders, leather, synthetic materials (such as plastic or synthetic leather), mesh, foam, or a combination thereon.

The material selected for sole structure 1625 and/or a sole member may possess sufficient durability to withstand the repetitive compressive and bending forces that are generated during running or other athletic activities. In some embodiments, the material(s) may include foams; polymers such as urethane or nylon; resins; metals such as aluminum, titanium, stainless steel, or lightweight alloys; or composite materials that combine carbon or glass fibers with a polymer material, ABS plastics, PLA, glass-filled polyamides, stereolithography materials (epoxy resins), silver, titanium, steel, wax, photopolymers and polycarbonate. The customized sole member may also be formed from a single material or a combination of different materials. For example, one side of a custom sole member may be formed from a polymer whereas the opposing side may be formed from a foam. In addition, specific regions may be formed from different materials depending upon the anticipated forces experienced by each region.

Referring to FIG. 16, first pair 1600 is a complementary pair of footwear, and includes a first article of footwear ("first article") 1650 for a left foot and a second article of footwear ("second article") 1620 for a right foot. As noted above, the various articles of footwear described herein can comprise upper 1602 and sole structure 1625. In different embodiments, sole structures may include different components. Specifically, in FIG. 16, first article 1650 includes a first customized sole member ("first member") 1630, and second article 1620 includes a second customized sole member ("second member") 1640. First member 1630 and second member 1640 are complementary with respect to one another. Each sole member is secured to respective upper 1602 (shown in dotted lines) and extends between the foot and the ground when first pair 1600 is worn by a user.

For purposes of this discussion, a complementary pair of articles refers to two articles of footwear that are designed to be worn as a pair by one user on a right foot and a left foot. Similarly, a complementary pair of sole members refers to two sole members that are designed or configured for use by one user on a left foot and a right foot.

For purposes of reference, a first upper surface 1660 is provided on the upper side of first member 1630, and a second upper surface 1662 is provided on the upper side of second member 1640. In addition, a first lower surface 1670 is provided on the bottom side of first member 1630, and a second lower surface 1672 is provided on the bottom side of second member 1640. Extending along the perimeter and thickness between first upper surface 1660 and first lower surface 1670 is a first sidewall 1680. Similarly, extending along the perimeter and thickness between second upper surface 1662 and second lower surface 1672 is a second sidewall 1682. Together, first upper surface 1660, first lower surface 1670, and first sidewall 1680 comprise an exterior surface of first member 1630. Likewise, second upper surface 1662, second lower surface 1672, and second sidewall 1682 together comprise an exterior surface of second member 1640.

Disposed along various portions of both first member 1630 and second member 1640 are apertures 150. Apertures 150 can extend through thickness 140 of first member 1630 and second member 1640, as described earlier with respect to cushioning elements of FIGS. 1-8.

In some embodiments, apertures 150 may be disposed over a majority of first member 1630 and/or second member 1640. In other embodiments, apertures 150 may be disposed in only a few areas or regions of first member 1630 and/or second member 1640. In FIG. 16, apertures 150 are shown formed along first upper surface 1660 and second upper surface 1662. Thus, openings 142 are visible in different areas of first upper surface 1660 and second upper surface 1662. It should be understood that the bottom surface (not shown) of each sole member may also include holes, corresponding to a second end of each through-hole aperture.

In first member 1630, apertures 150 are disposed along a first forefoot region 1614 such that each of the toes of a left foot (when first article 1650 is worn by a user) may experience greater cushioning. Furthermore, apertures 150 extend in a generally diagonal direction from a first medial side 1613 to a first lateral side 1611 throughout a first midfoot region 1616. Apertures 150 continue toward a first heel region 1618 and are generally disposed along first lateral side 1611 of first heel region 1618. Thus, a user's left foot may be supported by enhanced cushioned responses in the areas including apertures 150 as shown in first upper surface 1660.

Furthermore, apertures may comprise varying sizes. For example, in FIG. 16, a first group of apertures ("first group") 1676 disposed in first heel region 1618 may be relatively larger than a second group of apertures ("second group") 1678 disposed in first midfoot region 1616. The larger-sized apertures of first group 1676 can provide greater cushioning responses than the smaller-sized apertures of second group 1678 in different embodiments. Thus, in some embodiments, sole members may be customized for a user by varying the size of one or more apertures 150 in one part of the sole member relative to another part of the same sole member. In addition, apertures 150 may vary with respect to one another in shape along each surface, or the shapes may each be the same. In other embodiments, apertures 150 may differ from one another in both size and shape along the same surface.

It should be understood that, in different embodiments, the design and/or configuration of the sole members in a complementary pair of footwear may vary significantly. In some cases, they may vary in the arrangement, number, and/or size of apertures. In one embodiment, the sole members can be customized according to one or more types of ground surfaces or foot types that each sole member may be used. For example, the disclosed concepts may be applicable to footwear configured for use on indoor surfaces and/or outdoor surfaces. The configuration of sole members for a left foot or for a right foot may vary based on the properties and conditions of the surfaces on which the articles are anticipated to be used. Furthermore, each sole member may vary depending on whether a user's right foot includes contours or structural formations that differ from the user's left foot.

As shown in FIG. 16, second member 1640 includes apertures 150 disposed in a different configuration than first member 1630. For example, in second member 1640, there is a third group of apertures ("third group") 1686 disposed along a second heel region 1608 and a fourth group of apertures ("fourth group") 1688 disposed along a second midfoot region 1606. While first group 1676 of first member 1630 is disposed primarily toward first lateral side 1611 of first heel region 1618, third group 1686 of second member 1640 is disposed over a much greater area of second heel region 1608. In addition, the average size of each aperture in first group 1676 is larger than the average size of each aperture in third group 1686. Furthermore, fourth group 1688 in second member 1640 includes a substantially greater number of apertures 150 than in second group 1678 of first member 1630.

Thus, in some embodiments, a pair of articles may include sole members that differ with respect to the left foot and the right foot of a user. In other words, in different embodiments, the configuration of the sole member for a left foot may vary significantly with respect to the configuration of the sole member for a right foot. For purposes of this description, "configuration" encompasses all features of the sole members, including shape, size, number, orientation, and location of apertures. For example, referring to FIG. 16, first member 1630 may vary significantly with respect to second member 1640 according to the type of feet, user preferences, athletic event, or other factors that affect when or where first pair 1600 may be used. It should be noted that in some conventional embodiments, shoes can be mirror images of one another, including the sole members. In other words, in some conventional embodiments, each article in a pair of footwear is generally symmetrical with respect to each another. However, while a pair of shoes of any type conventionally includes a right shoe that is a mirror image of the left shoe in order to provide the same functionality to corresponding portions of each foot, this may not be optimal for users that require asymmetrical cushioning to optimize foot movement and comfort.

For purposes of this description, the terms "symmetric configuration" and "asymmetric configuration" are used to characterize pairs of articles and/or sole members of articles. As used herein, two sole members have a symmetric configuration when the pair of sole members has a symmetry about some common axis. In other words, the pair of sole members has a symmetric configuration when one sole member is a mirror image of the other sole member. In contrast, two sole members have an asymmetric configuration when there is no axis about which the sole members have a symmetry. In other words, the pair of sole members has an asymmetric configuration when the mirror image of one sole member is not identical to the other sole member. For example, in one embodiment, the aperture pattern(s) associated with a "left" article are not the same as the aperture pattern(s) on the complementary "right" article when the lower surface of the two sole members face one another in a mirror-image configuration. Thus, asymmetric can mean the sole members have no axis about which the aperture pattern(s) associated with two complementary sole members can be made symmetric (e.g., line up), or correspond exactly with one another.

It may be further understood that the characterizations of symmetric and asymmetric may be with reference to all features of the sole members, or with reference to only some subset of features. In particular, given a feature of the sole members, the sole members may be considered as symmetric or asymmetric with respect to that feature. In the following embodiments, for example, specific consideration is given to the asymmetry of the sole members with respect to one or more apertures in the sole member. It should also be understood that while a pair of articles of footwear may generally include some level of asymmetry, the asymmetry described herein is primarily directed to asymmetry in the location or number, shape, size, geometry, and/or orientation of apertures in the sole members. Asymmetry may also be provided by variations in the stiffness or rigidity of the sole members.

In some embodiments, athletic shoes having one or more sole members adapted for users involving asymmetric feet, where each of the articles of the pair is designed for optimal support for each of the wearer's feet, can provide enhanced agility, comfort, support, performance, balance, and increase flexibility in key areas, as well as allow for a more natural stride. By forming apertures 150 in each sole member that more closely correspond to the pressure distributions and/or movement of the feet, there can be an increase in overall performance. For example, asymmetry in the flexure of sole members can allow a user's feet to roll or curl along an axis that is off center and more closely correlated to actual use. This asymmetrical cushioning between first article 1650 and second article 1620 may provide a more natural feel to a user.

Referring now to FIG. 17, a bottom isometric view of an embodiment of second pair 1700 is shown. Second pair 1700 is a complementary pair of footwear, and includes a third article of footwear ("third article") 1710 for a right foot and a fourth article of footwear ("fourth article") 1720 for a left foot. The various articles of footwear can each comprise upper 1602 and sole structure 1625. In different embodiments, sole structure 1625 may include different components.

Specifically, in FIG. 17, third article 1710 includes a third customized sole member ("third member") 1730, and fourth article 1720 includes a fourth customized sole member ("fourth member") 1740. Third member 1730 is complementary with respect to fourth member 1740. Each sole member is secured to its respective upper 1602 (shown in dotted lines) and extends between the foot and the ground when second pair 1700 is worn by a user.

For purposes of reference, a third upper surface 1760 is provided on the upper side of third member 1730, and a fourth upper surface 1762 is provided on the upper side of fourth member 1740. In addition, a third lower surface 1770 is provided on the bottom side of third member 1730, and a fourth lower surface 1772 is provided on the bottom side of fourth member 1740. Extending along the perimeter and thickness between third upper surface 1760 and third lower surface 1770 is a third sidewall 1780. Similarly, extending along the perimeter and thickness between fourth upper surface 1762 and fourth lower surface 1772, is a fourth sidewall 1782. Together, third upper surface 1760, third lower surface 1770, and third sidewall 1780 comprise an exterior surface of third member 1730. Likewise, fourth upper surface 1762, fourth lower surface 1772, and fourth sidewall 1782 together comprise an exterior surface of fourth member 1740.

Disposed along various portions of both third member 1730 and fourth member 1740 are apertures 150. Apertures 150 can extend through thickness 140 of third member 1730 and fourth member 1740, as described earlier with respect to cushioning elements of FIGS. 1-8.

In some embodiments, apertures 150 may be disposed through the majority of third member 1730 and/or fourth member 1740. In other embodiments, apertures 150 may be disposed in only some areas or regions of third member 1730 and/or fourth member 1740. In FIG. 17, apertures 150 are shown formed along third upper surface 1760 and fourth upper surface 1762. Thus, openings 142 are visible in different areas of third upper surface 1760 and fourth upper surface 1762. It should be understood that the bottom surface (associated here with the foot contacting side of the sole member) of each sole member may also include holes. In third member 1730, apertures 150 are disposed along first medial side 1613 of first forefoot region 1614 such that a big toe of the right foot (when third article 1710 is worn by a user) may experience greater cushioning than any toes adjacent to the big toe. Furthermore, apertures 150 extend or are scattered across in a direction generally aligned with lateral axis 190 from first medial side 1613 to first lateral side 1611 throughout a portion of first forefoot region 1614 (see a fifth group of apertures ("fifth group") 1776). First midfoot region 1616 has relatively fewer apertures 150 (see a sixth group of apertures 1778). In FIG. 17, only three apertures are disposed in first midfoot region 1616. Apertures 150 are also present in a portion of first heel region 1618, and are disposed generally toward first medial side 1613 of first heel region 1618, as identified by a seventh group of apertures ("seventh group") 1779. Thus, a user's right foot may be supported by enhanced cushioned responses in the areas including apertures 150 as shown in third upper surface 1760.

As noted earlier, it should be understood that, in different embodiments, the design and/or configuration of the sole members in a pair of footwear may vary significantly. In some cases, they may vary in the arrangement, number, and/or size of apertures. As shown in FIG. 17, fourth member 1740 includes apertures 150 disposed in a different configuration than third member 1730. For example, in fourth member 1740, there is an eighth group of apertures ("eighth group") 1786 disposed along second heel region 1608 and a ninth group of apertures ("ninth group") 1788 disposed along second midfoot region 1606. No apertures are disposed over second forefoot region 1604. While seventh group 1779 of third member 1730 is disposed primarily toward first medial side 1613 of first heel region 1618, eighth group 1786 of fourth member 1740 is disposed over a larger area of second heel region 1608. In addition, the apertures in seventh group 1779 are closer together to one another, relative to the apertures in eighth group 1786 (which are spaced further apart). Furthermore, while third member 1730 includes apertures in fifth group 1776 in first forefoot region 1614 in the area associated with the big toe, second forefoot region 1604 of fourth member 1740 does not include any apertures.

As noted above, apertures 150 may be arranged to correspond to and/or support the contours of plantar surface 902 of foot 900 (as described above with reference to FIGS. 9-12). Thus, each sole member described herein can provide both general cushioning throughout varying regions of the foot by the inclusion of apertures 150 along the upper surface and lower surface of the sole members. However, in different embodiments, apertures 150 may be arranged for the purpose of providing specialized support in regions typically associated with greater force application or stresses in a particular athletic activity or sport. Thus, both first pair 1600 and second pair 1700 can include sole members where apertures 150 are disposed in a manner that can provide specialized support and cushioning to different areas of the sole member as per the customized fit of an individual user.

It should be understood that in addition to the physical characteristics of the athlete anticipated to wear the footwear, the sole members may also be configured based and/or according to the type of activity anticipated to be performed while wearing the footwear. Football players, depending on the position they play, can have a wide range of physical characteristics and abilities. For example, linemen may be relatively heavy, relatively slower, but also much more powerful than players who play other positions. Linemen may place larger loads on a sole member that may be sustained over longer durations, for example, up to one or two seconds, while engaging with opposing linemen. In this situation, athletic performance may benefit from an overall increase in the cushioning characteristics of the sole member by the methods described herein.

In contrast, skilled player positions, such as wide receivers, may be relatively lighter weight, but much faster. Skilled player positions, may place more explosive and transient loads on a sole structure, via sprinting, cutting, and jumping, and thus, may also maintain those loads for only a relatively short duration (for example, a split second). Linebackers may have physical characteristics and abilities that represent a combination of the physical traits and abilities of linemen and wide receivers. While linebackers may possess speed and agility and operate in open field like wide receivers, linebackers may also be larger, heavier, and more powerful, and also engage other players in tackling/blocking situations, like linemen.

In view of the differing demands linemen and wide receivers may place on sole members, sole members most suitable for each type of player may be configured differently. For example, the sole members of linemen shoes may be configured to be more stiff and durable (i.e., less flexible or cushioned), and also to distribute loads across the sole of the shoe. In contrast, wide receiver shoes may have sole members that are configured for light weight and more selective flexibility and stiffness at different areas of the foot.

Referring now to FIG. 18, a bottom isometric view of an embodiment of third pair 1800 is shown. Third pair 1800 is a complementary pair of footwear, and includes a fifth article of footwear ("fifth article") 1810 for a right foot and a sixth article of footwear ("sixth article") 1820 for a left foot. The various articles of footwear can comprise an upper 1602 and sole structure 1625. In different embodiments, sole structure 1625 may include different components.

Specifically, in FIG. 18, fifth article 1810 includes a fifth customized sole member ("fifth member") 1830, and sixth article 1820 includes a sixth customized sole member ("sixth member") 1840. Fifth member 1830 and sixth member 1840 are complementary with respect to one another. Each sole member is secured to respective upper 1602 (shown in dotted lines) and extends between the foot and the ground when third pair 1800 is worn by a user.

For purposes of reference, a fifth upper surface 1860 is provided on the upper side of fifth member 1830, and a sixth upper surface 1862 is provided on the upper side of sixth member 1840. In addition, a fifth lower surface 1870 is provided on the bottom side of fifth member 1830, and a sixth lower surface 1872 is provided on the bottom side of sixth member 1840. Extending along the perimeter and thickness between fifth upper surface 1860 and fifth lower surface 1870 is a fifth sidewall 1880. Similarly, extending along the perimeter and thickness between sixth upper surface 1862 and sixth lower surface 1872, is a sixth sidewall 1882. Together, fifth upper surface 1860, fifth lower surface 1870, and fifth sidewall 1880 comprise an exterior surface of fifth member 1830. Likewise, sixth upper surface 1862, sixth lower surface 1872, and sixth sidewall 1882 together comprise an exterior surface of sixth member 1840.

Disposed along various portions of both fifth member 1830 and sixth member 1840 are apertures 150. Apertures 150 can extend through thickness 140 of fifth member 1830 and sixth member 1840, as described earlier with respect to cushioning elements of FIGS. 1-8.

In some embodiments, apertures 150 may be disposed through or along a majority of fifth member 1830 and/or sixth member 1840. In other embodiments, apertures 150 may be disposed in only some areas or regions of fifth member 1830 and/or sixth member 1840. In FIG. 17, apertures 150 are shown formed along fifth upper surface 1860 and sixth upper surface 1862. Thus, openings 142 are visible in different areas of fifth upper surface 1860 and sixth upper surface 1862. It should be understood that the lower surface (associated here with the foot contacting side of the sole member) of each sole member may also include holes.

While the number, size, and shape of apertures 150 are provided for exemplary purposes, it should be understood that the arrangement and configuration of apertures 150 may be varied in order to tailor the shoe for comfort and stability on various surfaces, and/or in a variety of conditions. Additionally, such parameters may include, for example, the use of traction elements, placement of ground-engaging members, the relative softness or hardness of the ground-engaging members and/or sole structure in general, the relative flexibility of portions of the sole member material, and other such parameters.

In other words, in some embodiments, a sole member may be configured for versatility. For example, a sole member may be configured to provide traction and stability on a variety of surfaces, having a range of properties, and/or under various conditions. Different structural properties may be desired for different aspects of the sole member. Therefore, the structural configuration may be determined such that, even though a common material is used for all portions of the sole member, the different portions may be stiffer, or more flexible due to different shapes and sizes of the apertures. For example, the heel and the midfoot regions of the sole member may be formed with fewer apertures in order to provide relatively higher stiffness to these portions of the sole member. Whereas, the forefoot region of the sole member may be formed with a greater number of apertures, in order to provide higher flexibility and cushioning to the forefoot region. Greater flexibility in a forefoot region may enable natural flexion of the foot during running or walking, and may also enable the sole member to conform to surface irregularities, which may provide additional traction and stability on such surfaces.

In different embodiments, the distribution, size, and orientation of apertures can also take into account various traction elements (such as cleats) that may be in a pair of footwear configured for different athletic events. Furthermore, the aperture arrangement can take into account weight shifts to portions of the foot bone structure and the shoe outer sole in the direction of the player's motion. In some embodiments, the cushioning characteristics described herein may be arranged to complement or supplement a cleat configuration included along an outer sole surface. In one example, for footwear equipped with such cleats, the distribution and the orientation of the cleats on the outer sole may be configured to support a player's foot as it contacts the surface during running maneuvers. Thus, the geometry of the apertures, the position of the apertures on the sole, and/or the orientation of the apertures on the sole can be arranged in consideration of the player's dynamic maneuvers.

In other words, in some embodiments, there may be an aperture arrangement in the sole member that mimics and/or complements a cleat design that could be included in the footwear. In one embodiment, the aperture arrangement can cushion, reduce or significantly lessen the pressure experienced by the person wearing the footwear that includes one or more cleats (or other traction elements). In another embodiment, the aperture arrangement can simulate footwear with cleats, by providing areas of higher rigidity (where there are no apertures), and areas of greater flexibility and cushioning (where there are apertures). Thus, in some embodiments, even in footwear with no cleats, a sole member can include provisions for supporting a foot in a manner similar to footwear with cleats.

In FIG. 18, a ninth group of apertures ("ninth group") 1886 are disposed along first forefoot region 1614 and a tenth group of apertures ("tenth group") 1888 are disposed along first heel region 1618. It can be seen that ninth group 1886 is arranged such that two portions (a first portion 1850 and a second portion 1852) of first forefoot region 1614 remain substantially free of apertures 150. Similarly, a third portion 1854 extending between first forefoot region 1614 and first midfoot region 1616 is also substantially free of apertures 150. In addition, in first heel region 1618, there is a fourth portion 1856, a fifth portion 1857, a sixth portion 1858, and a seventh portion 1859 substantially free of apertures 150. The areas bounding each of these portions can be seen to include various arrangements of apertures 150.

In some embodiments, portions or locations where there are fewer apertures 150 may be portions of the sole member that correspond to places where ground-engaging members or cleats are disposed on an outer sole structure (i.e., the ground-engaging surface of the footwear). Thus, in one embodiment, apertures 150 may be arranged to coincide with areas of a sole member that are associated with ground-engaging members or traction elements. Examples of such ground-engaging members are disclosed in Auger et al., U.S. Pat. No. 8,713,819, issued May 6, 2014, titled "Composite Sole Structure," (previously U.S. patent application Ser. No. 13/009,549, filed Jan. 19, 2011), and Baucom et al., U.S. Pat. No. 8,584,379, issued Nov. 19, 2013, titled "Article of Footwear with Multiple Cleat Sizes" (previously U.S. patent application Ser. No. 12/848,264, filed Aug. 2, 2010) the disclosures of both of which are hereby incorporated by reference in their entirety. In some embodiments, arranging the apertures in locations that correspond to regions where traction elements would be present (or absent) can help provide an overall integrated footwear structure. Thus, in one embodiment, two or more layers of a sole structure can support and/or complement one another.

As noted earlier, it should be understood that, in different embodiments, the design and/or configuration of the sole members in a pair of footwear may be symmetrical. As shown in FIG. 18, sixth member 1840 includes apertures 150 disposed in a similar (mirrored) configuration relative to fifth member 1830. In one example, symmetry may be desirable in footwear that is optimized for use by athletes in a specific sport or activity.

Thus, the various cushioning elements as described here can provide a custom sole member with specialized responses to ground reaction forces. In one embodiment, the cushioning element may attenuate and distributes ground reaction forces. For example, when a portion of the custom sole member contacts the ground, the apertures disposed in cushioning element can help attenuate the ground reaction forces. The cushioning element may have the capacity to distribute the ground reaction forces throughout a substantial portion of the custom sole member. The attenuating property of this type of structure can reduce the degree of the effect that ground reaction forces have on the foot, and the distributive property distributes the ground reaction forces to various portions of a foot. In some embodiments, such features may reduce the peak ground reaction force experienced by the foot.

In other embodiments, the cushioning element designs disclosed in this description may also include provisions to achieve a non-uniform ground reaction force distribution. For example, the ground reaction force distribution of a custom sole member could provide a wearer with a response similar to that of barefoot running, but with attenuated ground reaction forces. That is, the custom sole member could be designed to impart the feeling of barefoot running, but with a reduced level of ground reaction forces. Additionally, in another example, the ground reaction forces could be more concentrated in the medial side of a foot than along the lateral side of the foot, thereby reducing the probability that the foot will over-pronate, or imparting greater resistance to eversion and inversion of the foot.

In some embodiments, the use of cushioning elements in orthotics for an article of footwear can help support weakened areas of the foot and assist the user in each step. While a relatively rigid material, as may be included in a custom sole member, can provide functional support to the foot, softer or more flexible regions associated with apertures 150 can absorb the loads put on the foot and provide protection. Such softer or cushioned regions can better absorb the loads placed on a foot, increase stabilization, and take pressure off uncomfortable or sore spots of the feet.

Other embodiments or variations of custom sole members may include other lattice structure designs or various combinations of the above-disclosed designs. It should be noted that the present description is not limited to cushioning elements having the geometry or aperture configurations of first pair 1600, second pair 1700, and third pair 1800. In different embodiments, each customized sole member may include further variations not depicted in the figures. Some variations may include differences in shape, size, contour, elevation, depression, curvature, and other variations. In other words, the custom sole members depicted herein are merely intended to provide an example of the many types of cushioning element-based sole member configurations that fall within the scope of the present discussion.

In different embodiments, sole members as well as any apertures in the sole members discussed herein may be formed using any other method known in the art. In some embodiments, any removal process (i.e., where a portion of a material is removed, subtracted, eliminated, etc.) may be used to form one or more apertures (e.g., apertures 150). For example, in some embodiments, a mechanical process may be used, including but not limited to ultrasonic machining, water jet machining, abrasive jet machining, abrasive water jet machining, ice jet machining, and/or magnetic abrasive finishing. In other embodiments, chemical processes may be utilized, including but not limited to chemical milling, photochemical milling, and/or eletropolishing. Furthermore, in some embodiments, electrochemical processes may be used. In other embodiments, thermal processes can be used, such as electrodischarge machining (EDM), laser beam machining, electron beam machining, plasma beam machining, and/or ion beam machining, or other processes. In another embodiment, hybrid electrochemical processes can be utilized, including but not limited to electrochemical grinding, electrochemical honing, electrochemical superfinishing, and/or electrochemical buffing. In addition, hybrid thermal processes may be used, such as electroerosion dissolution machining. In other embodiments, the material comprising the sole member may be modified using chemical processes, including temperature changes (e.g., freezing the material). Furthermore, the processes for forming the apertures may be applied or utilized after the article of footwear has been assembled, or the sole member has been associated with an upper or sole structure. In other words, the formation of apertures in a sole member may occur post-manufacturing of the article of footwear.

It should be understood that in other embodiments, the midsole can include a casing in a molded foam. In other words, embodiments of the sole member as described herein may be associated with the midsole of a sole structure. Thus, in some embodiments, a midsole may include a foam material. The foam material can comprise a 'skin' surface that is formed from a molding process. In some embodiments, the various removal processes described above (e.g., drilling, laser, chemical, EDM, water cutting, etc.) can be applied to the foam skin of a midsole and apertures can be formed in a manner similar to the embodiments discussed above.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A method for customizing sole members for an article of footwear, comprising:

obtaining information related to a pressure distribution associated with a first foot of a wearer;

obtaining information about preferences of the wearer related to cushioning of the article of footwear;

producing a first pattern of through-hole apertures based on the pressure distribution associated with the first foot of the wearer and the preferences of the wearer;

generating instructions to form the first pattern of through-hole apertures in a first sole member; and executing the instructions to produce a first customized sole member including the first pattern of through-hole apertures for the wearer.

2. The method of claim 1, further comprising:

obtaining information about the pressure distribution associated with a second foot of the wearer;

producing a second pattern of through-hole apertures corresponding to the pressure distribution associated with the second foot of the wearer;

generating instructions to form the second pattern of through-hole apertures in a second sole member; and executing the instructions to produce a second customized sole member, wherein the second customized sole member is complementary with respect to the first customized sole member such that the first customized sole member and the second customized sole member comprise the sole members of a single pair of footwear.

3. The method of claim 2, wherein the first pattern of through-hole apertures of the first customized sole member is asymmetric with respect to the second pattern of through-hole apertures of the second customized sole member.

4. The method of claim 1, wherein the step of obtaining information about the preferences of the wearer includes receiving the wearer's answers to questions regarding the wearer's preferences.

5. The method of claim 1, wherein the step of obtaining information about the pressure distribution of the wearer's first foot occurs in a first location where the wearer is physically present, and wherein the step of executing the instructions to produce the first customized sole member occurs in a second location wherein the wearer is not physically present.

6. The method of claim 1, further comprising forming the apertures in the first sole member using a laser.

7. The method of claim 1, further comprising generating a resiliency profile, the resiliency profile comprising data representing a personalized pressure distribution for the wearer.

8. The method of claim 7, wherein the step of producing the first pattern of through-hole apertures includes forming a first aperture and a second aperture, wherein the first aperture has a larger size than the second aperture.

9. The method of claim 7, wherein the step of producing the first pattern of through-hole apertures includes forming a first aperture, wherein the first aperture has a round cross-sectional shape.

10. The method of claim 1, wherein the step of obtaining information about the preferences of the wearer includes receiving user input from the wearer entered through a website that provides customization tools to the wearer.

11. A method for customizing a sole member for an article of footwear, comprising:

obtaining information related to a pressure distribution associated with a first foot of a wearer;

obtaining information about personal preferences of the wearer related to a design of the customized sole member;

producing a first pattern of apertures based on the pressure distribution associated with the first foot of the wearer and the personal preferences of the wearer;

generating instructions to form the first pattern of apertures in a first sole member; and executing the instructions to form the first pattern of apertures in the first sole member and producing a first customized sole member for the first foot of the wearer including the first pattern of apertures.

12. The method of claim 11, wherein the step of obtaining information about the personal preferences of the wearer includes receiving the wearer's answers to questions regarding the wearer's preferences.

13. The method of claim 11, wherein the step of obtaining information about the personal preferences of the wearer includes receiving user input from the wearer entered through a website that provides customization tools to the wearer.

14. The method of claim 11, wherein the step of producing the first pattern of apertures configures the apertures in the first pattern to create a desired visual or graphical effect.

15. The method of claim 11, further comprising obtaining information regarding an activity or sport for which the wearer intends to use the first customized sole member, and wherein the step of producing the first pattern of apertures is additionally based on the information obtained regarding the activity or sport.

16. The method of claim 15, further comprising obtaining information regarding one or more materials to be used to form the first customized sole member, and wherein the step of producing the first pattern of apertures is additionally based on the information obtained regarding the one or more materials.

17. The method of claim 16, wherein the step of obtaining information about the personal preferences of the wearer includes receiving the wearer's answers to questions regarding the wearer's preferences.

18. The method of claim 16, wherein the step of obtaining information about the personal preferences of the wearer includes receiving user input from the wearer entered through a website that provides customization tools to the wearer.

19. The method of claim 11, further comprising obtaining information regarding one or more materials to be used to form the first customized sole member, and wherein the step of producing the first pattern of apertures is additionally based on the information obtained regarding the one or more materials.

20. The method of claim 11, wherein the step of executing the instructions to form the first pattern of apertures includes forming the first pattern of apertures in a foam material of the first sole member using a laser.

* * * * *